US008866717B2

(12) United States Patent
Itakura et al.

(10) Patent No.: US 8,866,717 B2
(45) Date of Patent: Oct. 21, 2014

(54) DISPLAY DEVICE AND DRIVE METHOD PROVIDING IMPROVED SIGNAL LINEARITY

(75) Inventors: Naoyuki Itakura, Kanagawa (JP); Tomoyuki Fukano, Kanagawa (JP); Yoshiharu Nakajima, Kanagawa (JP); Tomohiko Sato, Kanagawa (JP); Takeya Takeuchi, Kanagawa (JP)

(73) Assignee: Japan Display, Inc., Chita (JP)

( * ) Notice: Subject to any disclaimer, the term of this patent is extended or adjusted under 35 U.S.C. 154(b) by 812 days.

(21) Appl. No.: 11/504,879

(22) Filed: Aug. 16, 2006

(65) Prior Publication Data

US 2007/0057887 A1 Mar. 15, 2007

(30) Foreign Application Priority Data

Aug. 18, 2005 (JP) ..... 2005-237924
Aug. 29, 2005 (JP) ..... 2005-248104

(51) Int. Cl.
*G09G 3/36* (2006.01)
*G09G 5/00* (2006.01)

(52) U.S. Cl.
CPC ..... *G09G 3/3655* (2013.01); *G09G 2320/0238* (2013.01); *G09G 3/3614* (2013.01); *G09G 2310/06* (2013.01); *G09G 2320/029* (2013.01); *G09G 3/3659* (2013.01); *G09G 2300/0876* (2013.01)
USPC ..... 345/94; 345/98; 345/211

(58) Field of Classification Search
CPC . G09G 3/3614; G09G 3/3655; G09G 3/3696; G09G 2300/0876; G09G 2320/0233; G09G 2320/0238; G09G 2320/04
USPC ..... 345/87–104, 204–206, 211; 349/187, 349/192; 324/770
See application file for complete search history.

(56) References Cited

U.S. PATENT DOCUMENTS

| | | | | |
|---|---|---|---|---|
| 5,296,847 | A * | 3/1994 | Takeda et al. | 345/92 |
| 5,686,932 | A * | 11/1997 | Tomita | 345/94 |
| 5,754,150 | A * | 5/1998 | Matsui | 345/89 |
| 6,864,883 | B2 * | 3/2005 | Hector et al. | 345/204 |
| 6,911,966 | B2 * | 6/2005 | Hector et al. | 345/96 |
| 6,961,041 | B2 * | 11/2005 | Ilda et al. | 345/90 |
| 7,202,880 | B2 * | 4/2007 | Takahashi | 345/690 |
| 2002/0084970 | A1 * | 7/2002 | Ozawa | 345/96 |

FOREIGN PATENT DOCUMENTS

| | | |
|---|---|---|
| JP | 03-012633 | 1/1991 |
| JP | 04-107525 | 4/1992 |

(Continued)

*Primary Examiner* — Joe H Cheng
*Assistant Examiner* — Keith Crawley
(74) *Attorney, Agent, or Firm* — Robert J. Depke; The Chicago Technology Law Group, LLC

(57) ABSTRACT

A display device having a pixel section including a plurality of pixel circuits arrayed in a matrix, a plurality of scan lines, a plurality of capacity lines, a plurality of signal lines, a drive circuit, and a generation circuit generating a small amplitude common voltage signal switching in level at a predetermined cycle, wherein each pixel circuit arranged at the pixel section contains a display element having a first pixel electrode and a second pixel electrode and a storage capacitor having a first electrode and a second electrode, the first pixel electrode of the display element, the first electrode of the storage capacitor, and one terminal of the switching element are connected, the second electrode of the storage capacitor is connected to the capacity lines arrayed in a corresponding row, and the common voltage signal is applied in a second pixel electrode of the display element.

18 Claims, 30 Drawing Sheets

(56) References Cited

FOREIGN PATENT DOCUMENTS

| | | |
|---|---|---|
| JP | 05-094153 | 4/1993 |
| JP | 05-289054 | 11/1993 |
| JP | 07-230075 | 8/1995 |
| JP | 11-119746 | 4/1999 |
| JP | 02-157815 | 6/1999 |
| JP | 2000-298459 | 10/2000 |
| JP | 2004-226737 | 8/2004 |

* cited by examiner

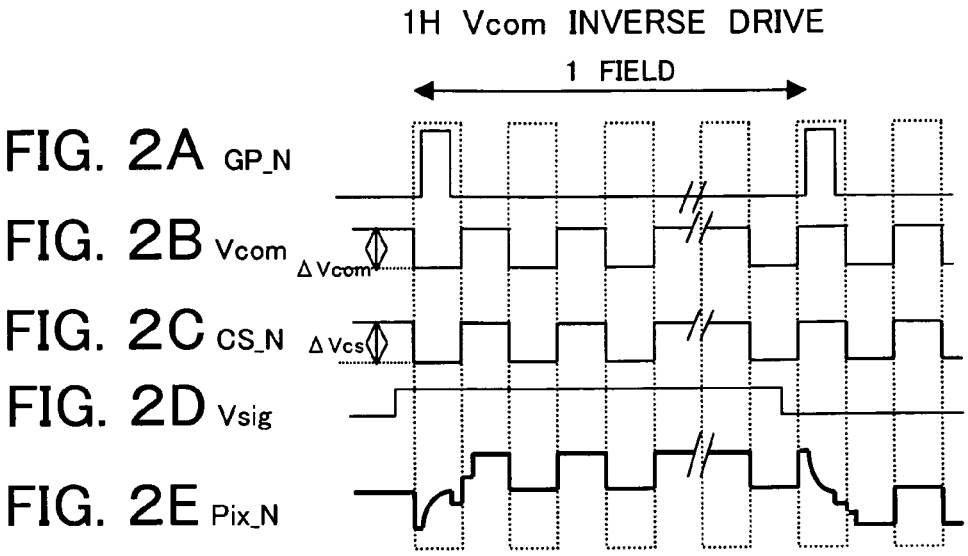
FIG. 3
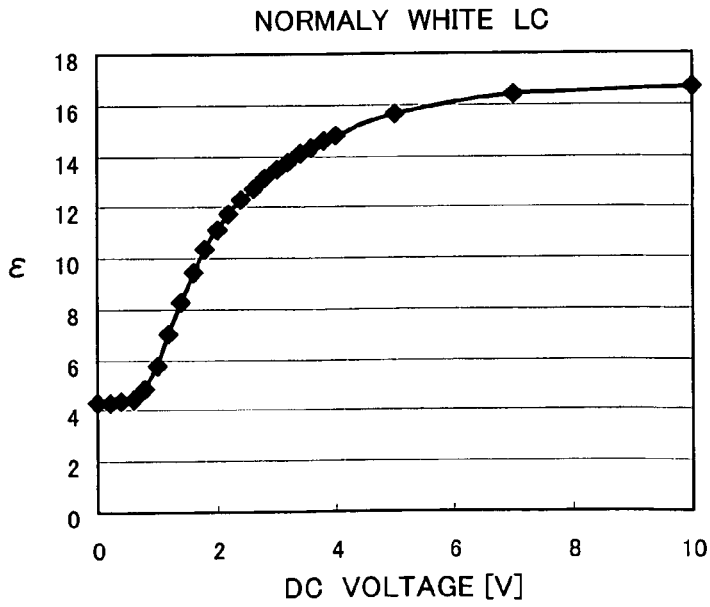

FIG. 8A LSCS
FIG. 8B Gate DT
FIG. 8C GP1
FIG. 8D GP2
FIG. 8E GP3
FIG. 8F GP4
FIG. 8G GP5
FIG. 8H CS_DT
FIG. 8I CS_1
FIG. 8J CS_2
FIG. 8K CS_3
FIG. 8L CS_4

FIG. 9
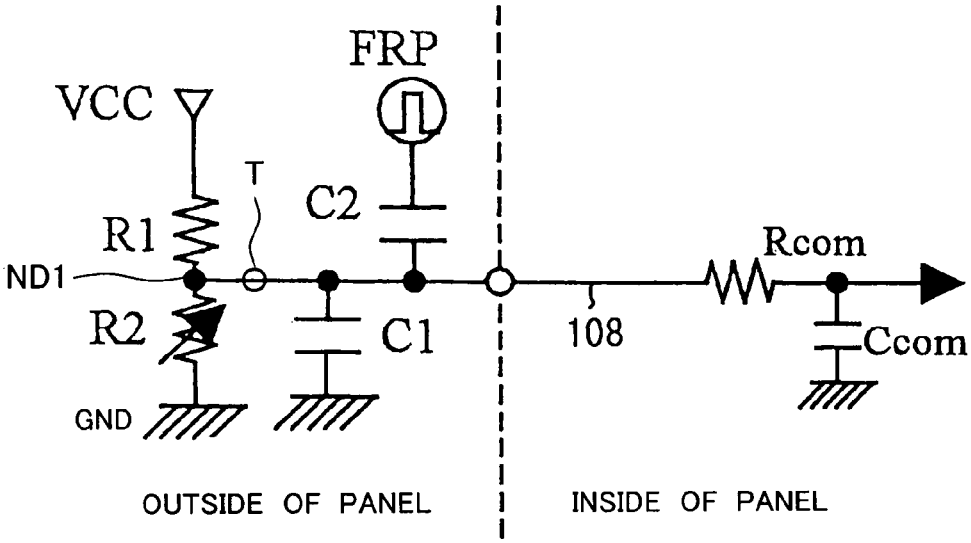
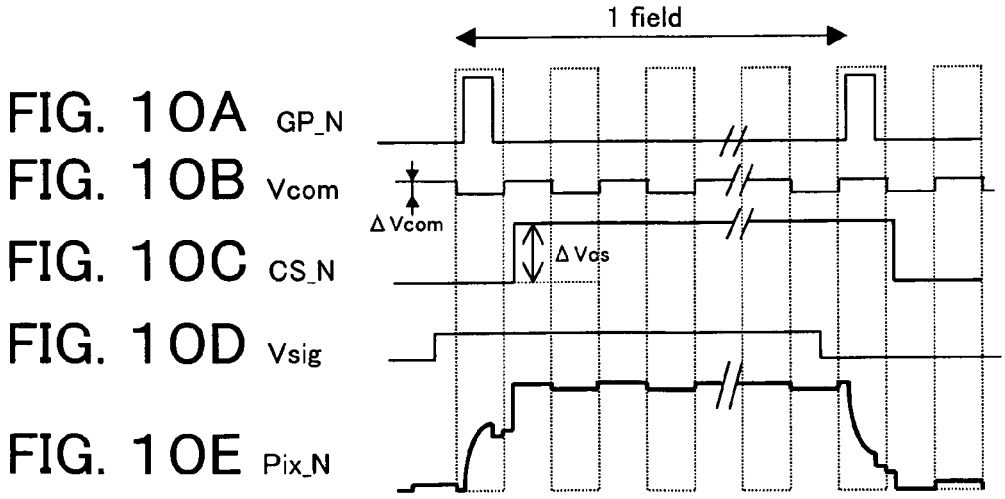

BEFORE MOUNTING CORRECTION CIRCUIT

AFTER MOUNTING CORRECTION CIRCUIT

DISPLAY DEVICE AND DRIVE METHOD PROVIDING IMPROVED SIGNAL LINEARITY

CROSS REFERENCE TO RELATED APPLICATION

The present invention contains subject matter related to Japanese Patent Application No. 2005-237924 filed in the Japan Patent Office on Aug. 18, 2005, and Japanese Patent Application No. 2005-248104 filed in the Japan Patent Office on Aug. 29, 2005 the entire contents of which being incorporated herein by reference.

BACKGROUND OF THE INVENTION

1. Field of the Invention

The present invention relates to an active matrix-type display device comprised of liquid crystal cells or other display elements of pixels (electrooptic elements) arrayed in a display region in a matrix and a method of driving the same.

2. Description of the Related Art

Display devices, for example, liquid crystal display devices using liquid crystal cells for the display elements of the pixels (electrooptic elements), feature thin profiles and low power consumptions. Utilizing these features, they are being used in, for example, personal digital assistants (PDAs), mobile phones, digital cameras, video cameras, personal computer-use display devices, and other electronic devices.

FIG. 1 is a block diagram showing an example of the configuration of a liquid crystal display device (for example, see Japanese Patent Publication (A) No. 11-119746 and Japanese Patent Publication (A) No. 2000-298459). The liquid crystal display device 1 has an effective pixel section 2, a vertical drive circuit (VDRV) 3, and a horizontal drive circuit (HDRV) 4.

The effective pixel section 2 is comprised of a plurality of pixel circuits 21 arrayed in a matrix. Each pixel circuit 21 is configured by a thin film transistor (TFT) as a switching element, a liquid crystal cell LC with a pixel electrode connected to the drain electrode of the TFT (or source electrode), and a storage capacitor Cs with one electrode connected to the drain electrode of the TFT. For these pixel circuits 21, scan lines (gate lines) 5-1 to **5-*m* are arranged along the pixel array direction for the rows and signal lines 6-1 to 6-*n* are arranged along the pixel array direction for the columns. Further, gate electrodes of the TFTs of the pixel circuit 21 are connected in row units to the identical scan lines 5-1 to 5*m*. Further, the source electrodes of the pixel circuits 21 (or drain electrodes) are connected in column units to the identical signal lines 6-1 to 6-*n***.

Further, in a general liquid crystal display device, a storage capacitor line Cs is arranged independently. Storage capacitors Cs are formed between the storage capacitor line and first electrodes of the liquid crystal cells LC. The storage capacitor line Cs receives as input a pulse in-phase with the common voltage VCOM and is used as a storage capacitor as well. In a general liquid crystal display device, the storage capacitors Cs of all pixel circuits 21 in the effective pixel section 2 are connected in common to one storage capacitor line Cs. Further, the second electrodes of the liquid crystal cells LC of the pixel circuits 21 are connected in common to, for example, a supply line 7 of the common voltage Vcom inverting in polarity with each horizontal scan period (1H).

The scan lines 5-1 to **5-*m* are driven by the vertical drive circuit 3, while the signal lines 6-1 to 6-*n* are driven by the horizontal drive circuit 4**.

The vertical drive circuit 3 performs a scan in the vertical direction (row direction) at each field period and successively selects pixel circuits 21 connected to the scan lines 5-1 to **5-*m* in row units. For example, when a scan pulse SP1 is given to the scan line 5-1 from the vertical drive circuit 3, pixels of the columns of the first row are selected, while when a scan pulse SP2 is given to the scan line 5-2, the pixels of the columns of the second row are selected. In the same way below, the scan pulses SP3, . . . , SPm are given in sequence to the scan lines 5-3, . . . , 5-*m***.

FIG. 2A to FIG. 2E are timing charts in a so-called 1H Vcom inversion drive unit of the general liquid crystal display device shown in FIG. 1.

Further, as another drive unit, a capacity coupling drive unit using coupling from the storage capacitor line Cs and modulating the voltage applied to the liquid crystals is known (for example, see Japanese Patent Publication (A) No. 2-157815).

The above-explained capacity coupling drive unit, in comparison to the 1H Vcom inversion drive unit, can improve the response speed of the liquid crystals by so-called overdrive and further can reduce audio noise generated by the Vcom frequency band and perform contrast compensation (optimization) etc. in superhigh definition panels.

SUMMARY OF THE INVENTION

However, when employing the capacity coupling drive unit described in Japanese Patent Publication (A) No. 2-157815 for a liquid crystal display device using a liquid crystal material having the characteristic of the liquid crystal dielectric constant $\epsilon$ for the applied voltage such as shown in FIG. 3 (for normally white specifications), there is the drawback of the white luminance becoming black (dropping) when trying to optimize the black luminance as shown in the following equation (1), FIG. 4, and FIG. 5. Due to this, in current liquid crystal display devices employing the capacity coupling drive unit, there is the drawback of not being able to simultaneously optimize the black luminance and the white luminance.

Further, when employing this capacity coupling drive unit described in Japanese Patent Publication (A) No. 2-157815 for a liquid crystal display device using a liquid crystal material having the characteristic of the liquid crystal dielectric constant $\epsilon$ with respect to the applied voltage shown in FIG. 3 (for example, normally white), there is the disadvantage that, when considering the effective pixel potential, large fluctuations in the liquid crystal cap and fluctuations in the gate oxide film thickness occur during production or large fluctuations occur in the relative dielectric constant of the liquid crystal at the time of changes in the ambient temperature. Further, when trying to optimize the black luminance, there is the disadvantage that the white luminance becomes black (ends up dropping).

$$\Delta Vpix1 = Vsig + \{Ccs/(Ccs+Clc)\} * \Delta Vcs - Vcom \quad (1)$$

In equation (1), Δvpix denotes the effective pixel potential, Vsig denotes the video signal voltage, Ccs denotes a storage capacity, Clc denotes a liquid crystal capacity, ΔVcs denotes the potential of the signal CS, and Vcom denotes the common voltage. As explained above, when trying to optimize the black luminance, the white luminance drops in the {Ccs/(Ccs+Clc)}*ΔVcs term of equation (1) to allow the nonlinearity of the liquid crystal dielectric constant to influence the effective pixel potential.

It is therefore desirable in the present invention to provide a display device enabling simultaneous optimization of the black luminance and the white luminance and a drive method of the same. Further, it is desirable to provide a liquid crystal device enabling optimization (correction) of the luminance.

According to a first embodiment of the invention, there is provided a display device having a pixel section including a plurality of pixel circuits, each writing video pixel data propagated through a switching element, arranged in a matrix, a plurality of scan lines arranged so as to correspond to an array of rows of the pixel circuits and control conduction of the switching elements, a plurality of capacity lines arranged so as to correspond to an array of rows of the pixel circuits, a plurality of signal lines arranged so as to correspond to an array of columns of the pixel circuits and carrying the pixel data, a drive circuit for selectively driving the plurality of scan lines and the plurality of capacity lines, and a generation circuit for generating a small amplitude common voltage signal switched in level at a predetermined cycle, wherein each pixel circuit arrayed at the pixel section includes a display element having a first pixel electrode and second pixel electrode and a storage capacitor having a first electrode and second electrode, a first pixel electrode of the display element, a first electrode of the storage capacitor, and one terminal of the switching element are connected, a second electrode of the storage capacitor is connected to the capacity line arrayed at a corresponding row, and a second pixel electrode of the display element is supplied with the common voltage signal.

Preferably, the drive circuit drives the scan lines of the selected row, writes pixel data into the desired pixel circuits, then drives the capacity lines of the same row.

More preferably, the drive circuit selects as a signal for driving a capacity line one of a first level and a second level lower than the first level and applies it to the corresponding capacity line.

Still more preferably, an amplitude of the common voltage signal and a value of a potential difference between the first level and the second level of the signal driving the capacity line are selected so that the effective pixel potential becomes a predetermined threshold value or less.

Still more preferably again, the pixel circuit has display elements comprised of liquid crystal cells.

According to a second embodiment of the invention, there is provided a method of driving a display device having a pixel section including a plurality of pixel circuits, each writing video pixel data propagated through a switching element over a signal line, arranged in a matrix, a plurality of scan lines arranged so as to correspond to an array of rows of the pixel circuits and control conduction of the switching elements, and a plurality of capacity lines arranged so as to correspond to an array of rows of the pixel circuits, each pixel circuit arrayed at the pixel section includes a display element having a first pixel electrode and second pixel electrode and a storage capacitor having a first electrode and second electrode, a first pixel electrode of the display element, a first electrode of the storage capacitor, and one terminal of the switching element are connected, and a second electrode of the storage capacitor is connected to the capacity line arrayed at a corresponding row, the method of a display device including the steps of: driving the capacity lines individually; applying a small amplitude common voltage signal switched in level at a predetermined cycle to the second pixel electrode of the display element; and driving the scan lines of the selected row; writing pixel data into the desired pixel circuits, then driving the capacity lines of the same row.

According to a third embodiment of the invention, there is provided a display device having a pixel section including a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal, and a correction circuit for correcting the signals driving the capacity lines of the drive circuit, wherein each pixel circuit arrayed at the pixel section includes a display element having a first pixel electrode and second pixel electrode and a storage capacitor having a first electrode and second electrode, a first pixel electrode of the display element pixel cell, a first electrode of the storage capacitor, and one terminal of the switching element are connected a second electrode of the storage capacitor is connected to the capacity line arrayed at a corresponding row, a second pixel electrode of the display element is supplied with the common voltage signal, and the correction circuit unit has a monitor section monitoring a pixel potential of the pixel section and a correction circuit correcting the signal driving the capacity line based on results of monitoring of the monitor circuit.

Preferably, the common voltage signal is a small amplitude signal switching in level at a predetermined cycle.

More preferably, the correction circuit unit has a switch selectively outputting a monitor pixel potential of the monitor section to the correction circuit.

Alternatively, preferably, the monitor section and an input section of the correction circuit are arranged in close proximity.

Alternatively, more preferably, the correction circuit unit has a switch selectively outputting a monitor pixel potential of the monitor section to the correction circuit.

Alternatively, preferably, the correction circuit unit includes a plurality of monitor pixels, first electrodes of the plurality of monitor pixels are connected in common, and a common connection line is connected to a connection line with the correction circuit.

Alternatively, more preferably, the correction circuit unit has a switch selectively outputting a monitor pixel potential of the monitor section to the correction circuit.

Alternatively, preferably, the drive circuit drives the scan lines of the selected row, writes pixel data into the desired pixel circuits, then drives the capacity lines of the same row.

Alternatively, more preferably again, the drive circuit selects as a signal for driving a capacity line one of a first level and a second level lower than the first level and applies it to the corresponding capacity line.

Alternatively, preferably, the pixel circuit has display elements including liquid crystal cells.

According to a fourth embodiment of the invention, there is provided a display device having a pixel section including a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal, and a reference driver for generating video pixel data to be propagated over a signal line, wherein each pixel circuit arrayed at the pixel section includes a display element having a first pixel electrode and second pixel electrode and a storage capacitor having a first electrode and second electrode, a first pixel electrode of the display element pixel cell, a first electrode of the storage capacitor, and one terminal of the switching element are connected, a second electrode of the storage capacitor is connected to the capacity line arrayed at a corresponding row, a second pixel electrode of the display element is supplied with the common voltage signal, and the reference driver has a monitor section monitoring a pixel potential of the pixel section and a correction circuit correcting the signal voltage in the reference driver generating based on results of monitoring of the monitor circuit.

According to the present invention, there is the advantage that both of the black luminance and the white luminance can be optimized. Further, there is the advantage that the luminance can be corrected.

BRIEF DESCRIPTION OF THE DRAWINGS

These and other objects and features of the present invention will become clearer from the following description of the preferred embodiments given with reference to the attached drawings, wherein:

FIGS. 2A to 2E are timing charts in a so-called 1H Vcom inversion drive unit of the general liquid crystal display device shown in FIG. 1;

FIG. 3 is a graph showing the relation between the applied voltage and a relative dielectric constant of a normally white liquid crystal;

FIG. 9 is a circuit diagram showing an example of the configuration of a common voltage generation circuit according to the present embodiment;

FIGS. 10A to 10E are timing charts showing drive waveforms of a main liquid crystal cell of the present embodiment;

DESCRIPTION OF THE PREFERRED EMBODIMENTS

Below, embodiments of the present invention will be explained with reference to the figures.

First Embodiment

Figure 6:
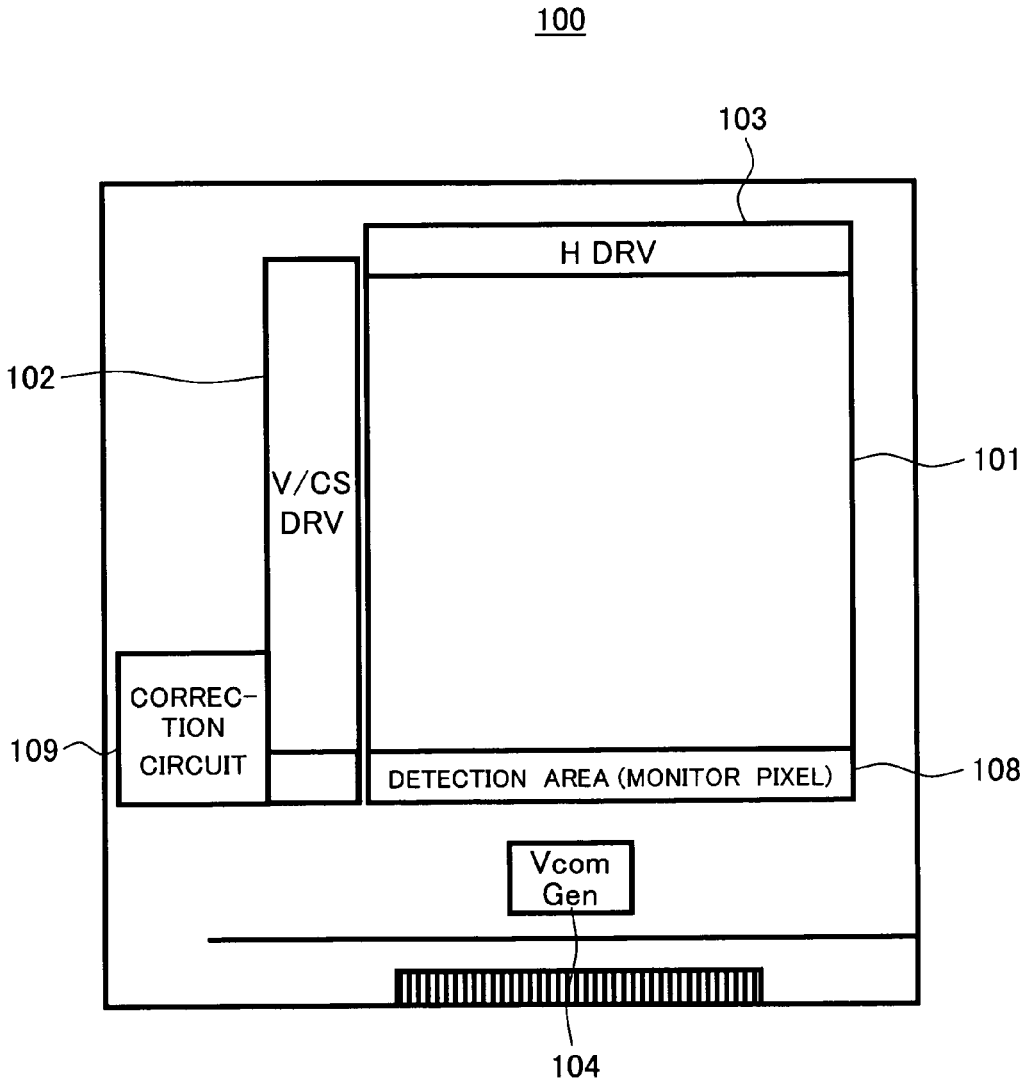
FIG. 6 is a diagram showing an example of the configuration of the active matrix type display device according to an embodiment of the present invention.

FIG. 6 is a figure showing an example of the configuration of an active matrix type display device according to a first embodiment of the present invention using for example liquid crystal cells as display elements of pixels (electrooptic elements).

The display device 100 has as its main constituent elements an effective pixel section 101, a vertical drive circuit (VDRV) 102, a horizontal drive circuit (HDRV) 103, and a common voltage generation circuit (VcomGen) 104.

Figure 7:
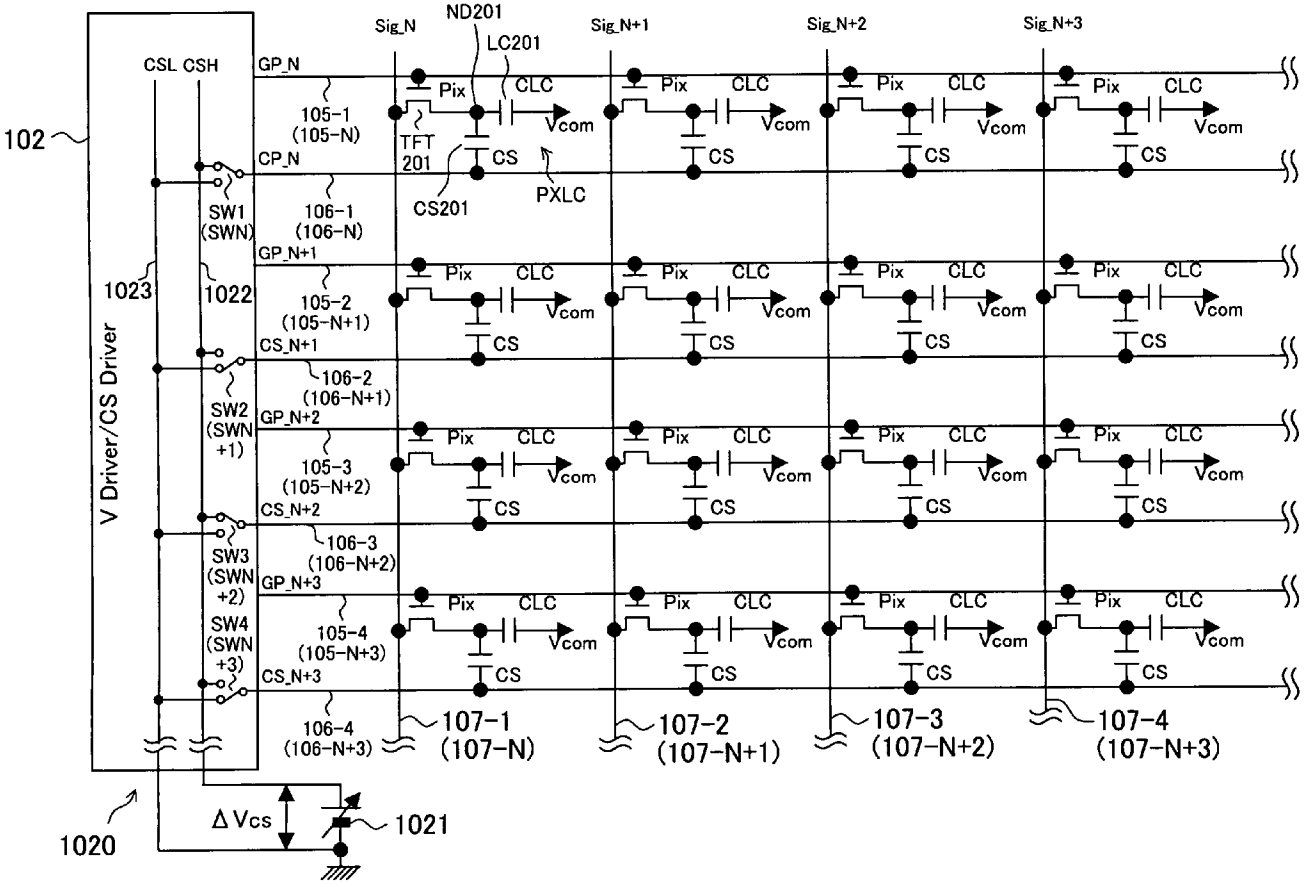
FIG. 7 is a circuit diagram showing a specific example of the configuration of the pixel section of a circuit of FIG. 1.
Figure 8:
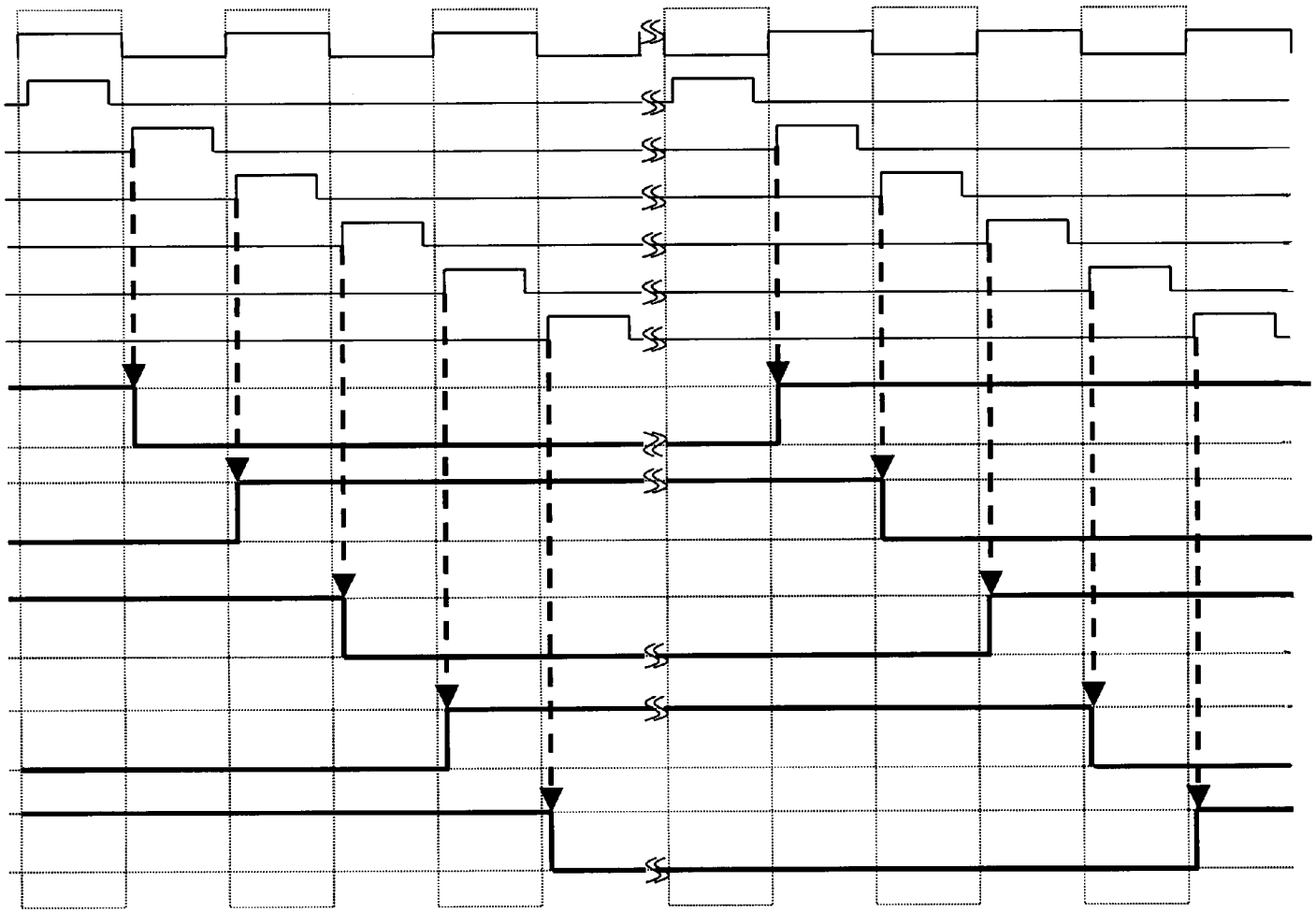
FIGS. 8A to 8L are timing charts showing an example of driving the gate lines and the storage line of the vertical drive circuit of the present embodiment.

The effective pixel section 101, as shown in FIG. 7, is comprised of a plurality of pixel circuits PXLC arrayed in an m×n matrix. Specifically, to enable normal display overall, for example, 320×RGB×320 number of pixel circuits are arrayed. Note that in FIG. 7, for simplification of the figure, this is shown as a 4×4 matrix array.

Each pixel circuit PXLC, for example, as shown in FIG. 7, is configured by a TFT (thin film transistor) 201 as a switching element, a liquid crystal cell LC201 with a first pixel electrode connected to a drain electrode (or source electrode) of the TFT 201, and a storage capacitor Cs201 with a first electrode connected to the drain electrode of the TFT 201. Note that connection point of the drain of the TFT 201, the first pixel electrode of the liquid crystal cell LC201, and the first electrode of the storage capacitor CS201 forms the node ND201.

Gate lines (scan lines) 105-1 to **105-*m* and storage capacitor lines (hereinafter referred to as "storage lines") 106-1 to 106-*m* are arranged along the pixel array direction for each row of these pixel circuits PXLC, and signal lines 107-1 to 107-*n*** are arranged along the pixel array direction for each column.

Further, the gate electrodes of the TFTs 201 of the pixel circuits PXLC are connected to the identical gate lines 105-1 to **105-*m* in row units. The second electrodes of the storage capacitors Cs of the pixel circuits PXLC are connected the identical storage lines 106-1 to 106-*m* in row units. Further, the source electrodes (or drain electrodes) of the pixel circuits PXLC are connected to the identical signal lines 107-1 to 107-*n* in column units. Further, the second pixel electrodes of the liquid crystal cells LC201** of the pixel circuits PXLC are connected in common to a not shown supply line of the small amplitude common voltage VCOM inverting in polarity in one horizontal scan period (1H).

The gate lines 105-1 to **105-*m* are driven by the gate driver of the vertical drive circuit 102, the storage lines 106-1 to 106-*m* are driven by the capacitor driver (CS driver) of the vertical drive circuit 102, and the signal lines 107-1 to 107-*n* are driven by the horizontal drive circuit 103**.

Further, the effective pixel section 101 is formed with a dummy pixel section 108 as a monitor circuit containing one row or one pixel. The dummy pixel section 108 has the same pixel configuration as ordinary effective pixels and can, for example, be formed by forming an extra row in the effective pixel section 101, by assigning to it the m-th row positioned at the lowest position of the effective pixel section 101, etc. This dummy pixel section 108 detects the potential of the connection node ND201 of the pixel circuit PXLC and outputs it to the detection circuit 109. The dummy pixel section 108 is provided for the following reasons. Fluctuations in the dielectric constant due to changes in the drive temperature and fluctuations in the thickness of the insulating film forming the storage capacitor CS201 and fluctuations in the liquid crystal cell cap due to fluctuations in mass production cause the voltage applied to the liquid crystals to fluctuate. This amount of fluctuation is detected electrically by provision of a dummy pixel section 108. As explained later, the storage signal CS output from the CS drive is corrected so as to enable the pixel potential detected from the dummy pixel section 108 to be any potential.

The vertical drive circuit 102 basically scans in the vertical direction (row direction) for each field period and successively selects pixel circuits PXLC connected to the gate lines 105-1 to **105-*m* in row units. That is, the vertical drive circuit 102 gives the gate line 105-1 a gate pulse GP1 to select the pixels of the columns of the first row and gives the gate line 105-2 a gate pulse GP2 to select the pixels of the columns of the second row. After this, in the same way, it successively gives the gate lines 105-3, . . . , 105-*m* the gate pulses GP3**, . . . , GPm.

Further, the vertical drive circuit 102 successively gives each of the storage lines 106-1 to **106-*m* independently laid for each gate line a selected first level (CSH, for example 3V to 4V) or second level (CSL, for example 0V) capacity signal (hereinafter referred to as a "storage signal") CS1** to CSm.

FIGS. 8A to 8L are timing charts showing examples of the driving of gate lines and storage lines of the vertical drive circuit of the present embodiment.

The vertical drive circuit 102, for example, drives in sequence from the first row the gate lines 105-1 to **105-*m* and the storage lines 106-1 to 106-*m*, however, after driving a gate line by a gate pulse (after a signal write operation), it alternately selects and applies the first level CSH and the second level CSH as the levels of the storage signals CS1 to CSm applied to the storage lines 106-1 to 106-*m* at the timings of the rising edges of the gate pulses of the next gate lines as explained below. For example, when the vertical drive circuit 102 selects the first level CSH and applies the storage signal CS1 to the first row storage line 106-1, it selects the second level CSL and applies the storage signal CS2 to the second row storage line 106-2, selects the first level CSH and applies the storage signal CS3 to the third row storage line 106-3, and selects the second level CSL and applies the storage signal CS4 to the fourth row storage line 106-4. In the same way below, it alternately selects the first level CSH and the second level CSL and applies the storage signals CS5 to CSm to the storage lines 106-5 to 106-*m*. Further, when it selects the second level CS1 and applies the storage signal CS1 to the first row storage line 106-1, it selects the first level CSH and applies the storage signal CS2 to the second row storage line 106-2, selects the second level CSL and applies the storage signal CS3 to the third row storage line 106-3, and selects the first level CSH and applies the storage signal CS4 to the fourth row storage line 106-4. In the same way below, it alternately selects the second level CSL and the first level CSH and applies the storage signals CS5 to CSm to the storage lines 106-5 to 106*m***.

In the present embodiment, the storage lines 106-1 to **106-*m* are driven after the trailing end of the gate pulse GP (after the write operation of the signal line) and coupled through the storage capacitor CS201 to change the pixel potential (potential of node ND201**) and modulate the voltage applied to the liquid crystals.

FIG. 7 is a schematic view of an example of a level selection output unit of the CS driver 1020 of the vertical drive circuit 102. The CS driver 1020 is configured by a variable power source 1021, a first supply line 1022 connected to a positive pole side of the power source 1021, a second level supply line 1023 connected to a negative pole side of the power source 1021, and switches SW1 to SWm selectively connecting the first level supply line 1022 or the second level supply line 1023 with the storage lines 106-1 to **106-*m*** laid for each row of the pixel array.

Further, in FIG. 7, ΔVcs shows the level difference (potential difference) of the first level CSH and the second level CSL. As explained later, this ΔVcs and the amplitude ΔVcom of the alternate common voltage Vcom of the small amplitude are selected as values that can optimize both the black luminance and the white luminance. For example, as explained later, the values of ΔVcom and ΔVcs are determined so that the effective pixel potential ΔVpix_W applied to a liquid crystal at the time of the white display becomes a value of not more than 0.5V.

The vertical drive circuit 102 has a plurality of shift registers VSR containing groups of vertical shift registers and provided corresponding to gate buffers to which are connected gate lines arrayed for each row in accordance with the pixel array. Each shift register VSR is supplied with a vertical start pulse VST instructing the start of a vertical scan generated by a not shown clock generator and a vertical clock VCK serving as the reference for the vertical scan (or the vertical clocks VCK and VCKX with opposite phases). For example, each shift register performs a shift operation on the vertical start pulse VST in synchronization with the vertical clock VCK and supplies the result the corresponding gate buffer. Further, the vertical start pulse VST is propagated from the top of the effective pixel section 101 or from the bottom and is shifted in sequence into each shift register. Therefore, basically, the gate lines are driven in sequence through the gate buffers by the vertical clocks supplied from the shift registers VSR.

The horizontal drive circuit 103, based on the horizontal start pulse HST instructing the start of the horizontal scan and the horizontal clock HCK (or the horizontal clocks HCK and HCKX with opposite phases) serving as the reference of the horizontal scan, successively samples the input video signal Vsig at each 1H (H is the horizontal scan period) and performs a write operation on the pixel circuits PXLC selected in row units through the signal lines 107-1 to **107-*n* by the vertical drive circuit 102**.

The common voltage generation circuit 104 generates the small amplitude common voltage VCOM inverting in polarity at each horizontal scan period (1H) and passes it through not shown supply lines to supply it in common to the second pixel electrodes of the liquid crystal cells LC201 of all pixel circuits PXLC of the effective pixel section 101. The value of the amplitude ΔVcom of the amplitude of the common voltage Vcom is selected as a value that can optimize the difference ΔVcs between the first level CSH and second level CSL of the storage signal CS and the black luminance and the white luminance. For example, as explained later, the values of ΔVcs and ΔVcom are determined so that the value of the effective pixel potential ΔVpix_W applied to the liquid crystal at the time of white display becomes no more than 0.5V.

In FIG. 6, a configuration in which the common voltage generation circuit 104 is provided inside the liquid crystal panel is shown as an example, however, it is also possible to provide it outside the panel and supply the common voltage Vcom from outside the panel.

FIG. 9 is a circuit diagram showing an example of the configuration of a common voltage generation circuit according to the present embodiment. In the example of FIG. 9, a case where a small amplitude common voltage Vcom is generated outside of the panel is shown.

The common voltage generation circuit of FIG. 9 is configured by flicker adjustment resistance elements R1 and R2, a smoothening capacitor C1, a capacitor C2 for applying only a small amplitude ΔVcom, a line resistance Rcom of the Vcom supply line 108, and a parasitic capacity Ccom of the Vcom supply line 108.

The resistance elements R1 and R2 are serially connected between the power voltage VCC supply line and the ground line GND. A voltage divided by the two resistance elements R1 and R2 is generated at the connection node ND1 of the resistance elements. The resistance element R2 is a variable resistance and enable the generated voltage to be adjusted. The connection node ND1 is connected to a panel terminal T. A first electrode of the capacitor C1 is connected to a connection line of the connection node ND1 and the terminal T, while a second electrode of the capacitor C1 is grounded. A first electrode of the capacitor C2 is connected to a connection line of the connection node ND1 and the terminal T, while a second electrode is connected to a supply line of the signal FRP.

In the common voltage generation circuit of FIG. 9, the small amplitude ΔVcom is determined according to the following equation:

$$\Delta Vcom=\{C2/(C1+C2+Ccom)\}\times FRP \tag{2}$$

For the small amplitude, it is possible to use capacity coupling or to digitally generate and use it. The value of the small amplitude ΔVcom is an extremely small amplitude, for example, should be an amplitude of 10 mV to 1.0V or so. The reasons are that otherwise, the improvement of the response speed by overdrive, the reduction of audio noise, and other effects weaken.

As explained above, in the present embodiment, when the liquid crystal display device 100 is driven utilizing capacity coupling, the value of the amplitude ΔVcom of the amplitude of the common voltage Vcom and the value of the difference ΔVcs between the first level CSH and second level CSL of the storage signal CS are selected as values that can optimize the black luminance and white luminance. For example, the values of ΔVcs and Δvcom are selected so that effective pixel potential ΔVpix_W applied to the liquid crystal at the time of white display becomes a value less than 0.5V. Below, the capacity coupling drive operation of the present embodiment will be explained in further detail.

FIGS. 10A to 10E are timing charts showing the drive waveforms of the main liquid crystal cells of the present embodiment. FIG. 10A shows the gate pulse GP_N, FIG. 10B shows the common voltage Vcom, FIG. 10C shows the storage signal CS_N, FIG. 10D shows the video signal Vsig, and FIG. 10E shows the signal Pix_N applied to the liquid crystal cells.

In the capacity coupling drive operation of the present embodiment, the common voltage Vcom is generated not as a constant direct current voltage, but as a small amplitude, alternating signal inverting in polarity at each horizontal scan period (1H) and is applied in the second pixel electrode of the liquid crystal cell LC201 of each pixel circuit PXLC. Further, the storage signal CS_N is given selected as either a first level (CSH, for example, 3V to 4V) or a second level (CSL, for example, 0V) at each of the storage lines 106-1 to **106-*m*** arranged independently in accordance with each gate line. When driven in this way, the effective pixel potential ΔVpix applied to the liquid crystals is given by the next equation.

$$\begin{aligned}\Delta Vpix3 &= Vsig + \frac{Ccs}{Ccs + Clc + Cg + Csp} * \Delta Vcs + \\ &\quad \frac{Clc}{Ccs + Clc + Cg + Csp} * \frac{\Delta Vcom}{2} - Vcom \\ &\approx Vsig + \frac{Ccs}{Ccs + Clc} * \Delta Vcs + \frac{Clc}{Ccs + Clc} * \frac{\Delta Vcom}{2} - Vcom\end{aligned} \tag{3}$$

Figure 11:
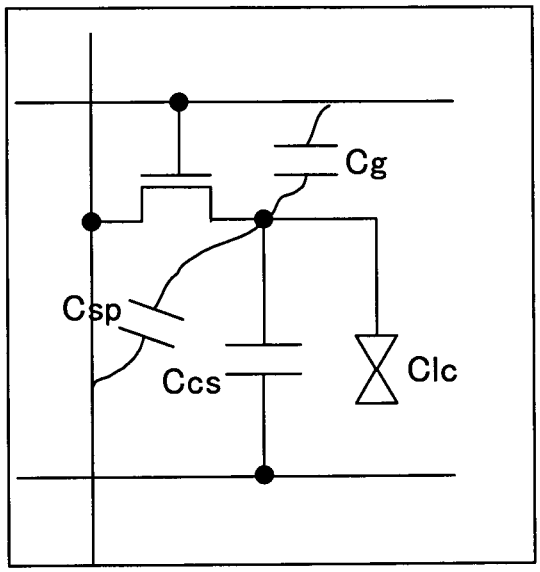
FIG. 11 is a diagram showing the capacitors of the liquid crystal cells in equation 3.

As shown in FIG. 11, in equation (3), Vsig denotes the video signal voltage, Ccs denotes a storage capacitor, C1*c* denotes a liquid crystal capacity, Cg denotes a capacity between the node ND201 and the gate line, Csp denotes a capacity between the node ND201 and the signal line, ΔVcs denotes the potential of the signal CS, and Vcom denotes the common voltage. In equation (3), the second term {(Ccs/

Ccs+Clc)*ΔVcs} of the approximation equation is a term wherein the low shade (the white luminance side) becomes black (drops) due to the nonlinearity of the liquid crystal dielectric constant, while the third term {(Ccl/Ccs+Clc)*ΔVcom/2} of the approximation equation is a term where the low shade side becomes whiter due to the nonlinearity of the liquid crystal dielectric constant. That is, the inclined part where the low shade (white luminance side) of the second term of the approximation equation becomes blacker (drops) is compensated for by the function of whitening the low shade side by the third term. Further, the optimum contrast can be obtained by selecting values that can optimize both the black luminance and the white luminance.

Figure 12A:
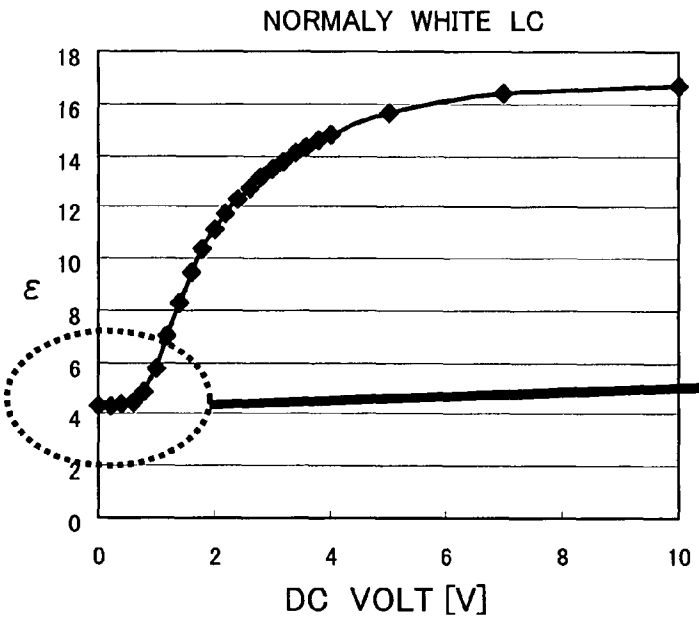
FIGS. 12A and 12B are graphs explaining the selection criteria of the effective pixel potential ΔVpix_W applied to the liquid crystal at the time of the white display in a case of using a liquid crystal material used in a liquid crystal display device (normally white)
Figure 12B:
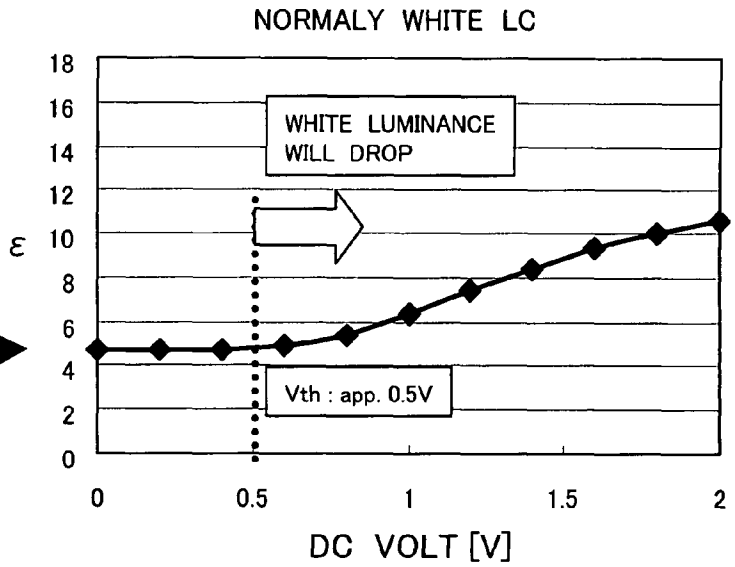

FIGS. 12A and 12B are diagrams for explaining the selection criteria of the effective pixel potential ΔVpix_W applied to the liquid crystals at the time of white display in the case of using a liquid crystal material (normally white liquid crystal) used in liquid crystal display devices. FIG. 12A is a diagram showing the characteristic of the dielectric constant ϵ with respect to the applied voltage, while FIG. 12B is a diagram showing an enlargement of the region where the characteristic of FIG. 12A changes greatly.

As shown in the diagrams, with the characteristic of the liquid crystal used in liquid crystal display devices, the white luminance will drop if a voltage of about 0.5V or more is applied. Therefore, to optimize the white luminance, the effective pixel potential ΔVpix_W applied to the liquid crystal at the time of white display has to be not more than 0.5V. Therefore, the values of the ΔVcs and the ΔVcom are determined so that the effective pixel potential ΔVpix_W becomes no more than 0.5V.

As actually evaluated results, the optimum contrast was obtained at the time of ΔVcs=3.8V and ΔVcom=0.5V.

Figure 13:
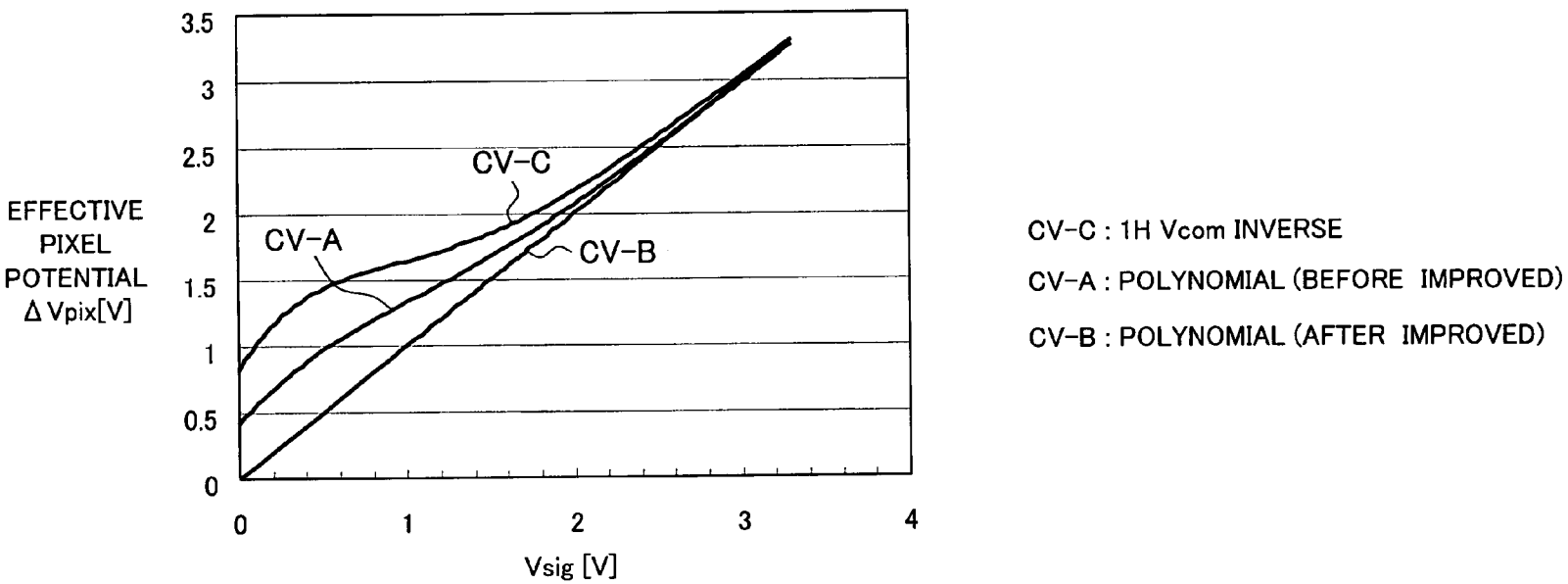
FIG. 13 is a graph showing the relationship of the video signal voltage and the effective pixel potential of the drive unit according to an embodiment of the present invention, the related capacity coupling drive unit, and the ordinary 1H Vcom drive unit.

FIG. 13 is a graph showing the relationship of the video signal voltage and effective pixel potential of a drive unit according to an embodiment of the present invention, the related capacity coupling drive unit, and an ordinary 1H Vcom drive unit. In FIG. 13, the abscissa shows the video signal voltage Vsig, and the ordinate shows the effective pixel potential ΔVpix. Further, in FIG. 13, the line shown by curve CV-A shows the characteristic of a drive unit according to an embodiment of the present invention, the line shown by curve CV-B shows the characteristic of the related capacity coupling drive unit, and the line shown by curve CV-C shows the characteristic of the ordinary 1H Vcom drive unit.

As will be understood from FIG. 12, according to the drive unit of the present embodiment, a sufficient improvement of the characteristic is obtained in comparison to the related capacity coupling drive unit.

Figure 14:
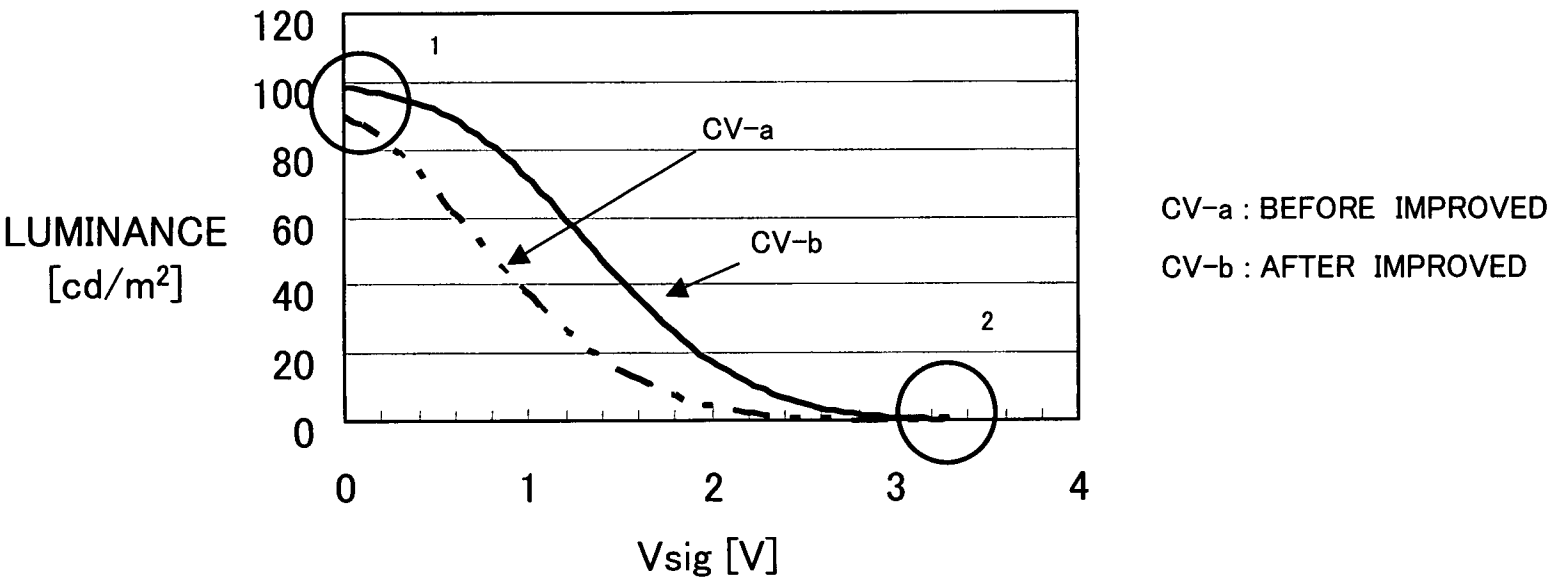
FIG. 14 is a graph showing the relationship of the video signal voltage and luminance of the drive unit according to an embodiment of the present invention and the related capacity coupling drive unit.

FIG. 14 is a graph showing the relationship of the video signal voltage and luminance of the drive unit according to an embodiment of the present invention and the related capacity coupling drive unit. In FIG. 14, the abscissa shows the video signal voltage Vsig, while the ordinate shows the luminance. Further, in FIG. 14, the line shown by curve CV-a shows the characteristic of the drive unit according to an embodiment of the present invention, while the line shown by curve CV-b shows the characteristic of the related capacity coupled drive unit.

As will be understood from FIG. 14, in the related capacity coupled drive unit, when optimizing the black luminance (2), the white luminance (1) dropped. As opposed to this, according to the drive unit of the present embodiment, by making the Vcom a small amplitude, it is possible to optimize both the black luminance (1) and white luminance (1).

The following equation (4) shows the value of the effective pixel potential ΔVpix_B at the time of a black display and the effective pixel potential ΔVpix_W at the time of white display in the case of black display when setting specific numerical values into equation (3) of the drive unit according to the present embodiment. Further, equation (5) shows the value of the effective pixel potential ΔVpix_B at the time of a black display and the effective pixel potential ΔVpix_W at the time of white display in the case of black display when setting specific numerical values into equation (1) of the related capacity coupled drive unit.

(1) At time of black display (4)

$$\Delta\text{Vpix_B} = Vsig + \frac{Ccs}{Clc\,b + Ccs} \times \Delta Vcs + \frac{Clc\,b}{Clc\,b + Ccs} \times \frac{\Delta Vcom}{2} - Vcom$$
$$= 3.3\text{ V} + 1.65 - 1.65\text{ V}$$
$$= 3.3\text{ V (Optimization of the black luminance)}$$

(2) At time of white display $$\Delta\text{Vpix_W} = Vsig + \frac{Ccs}{\text{Clc_w} + Ccs} \times \Delta Vcs + \frac{\text{Clc_w}}{\text{Clc_w} + Ccs} \times \frac{\Delta Vcom}{2} - Vcom$$
$$= 0.0\text{ V} + 2.05 - 1.65\text{ V}$$
$$= 0.4\text{ V (Optimization of the white luminance)}$$

(1) time of black display (5)

$$\Delta\text{Vpix_B} = Vsig + \frac{Ccs}{\text{Clc_b} + Ccs} \times \Delta Vcs - Vcom$$
$$= 3.3\text{ V} + 1.65 - 1.65\text{ V}$$
$$= 3.3\text{ V (Optimization of white luminance)}$$

(2) time of white display $$\Delta\text{Vpix_W} = Vsig + \frac{Ccs}{\text{Clc_w} + Ccs} \times \Delta Vcs - Vcom$$
$$= 0.0\text{ V} + 2.45 - 1.65\text{ V}$$
$$= 0.8\text{ V (White luminance drops)}$$

As shown in equation (4) and equation (5), at the time of black display, the effective pixel potential ΔVpix_B becomes 3.3V and the black luminance is optimized in both the drive unit according to the present embodiment and the related drive unit. At the time of white display, as shown in equation (5), the effective pixel potential ΔVpix_W of the related drive unit becomes a value more than 0.5V, that is, 0.8V, so the white luminance drops as explained with reference to FIG. 12B. As opposed to this, the effective pixel potential ΔVpix_W of the drive unit according to the present embodiment becomes a value less than 0.5V, that is, 0.4V, so the white luminance is optimized as explained with reference to FIG. 12B.

Next, the operation by the above configuration will be explained.

A shift register of the vertical drive circuit 102 is supplied with a vertical start pulse VST instructing the start of the vertical scan and the vertical clocks VCK and VCKX with opposite phases serving as the criteria of the vertical scan generated by a not shown clock generator. The shift register performs a level shift operation on the vertical clocks and delays them by differing delay times. For example, in the shift register, the vertical start pulse VST is shifted synchronized with the vertical clock VCK and supplied to the corresponding gate buffer. Further, the vertical start pulse VST is propagated from the top or bottom of the effective pixel section 101 and is successively shifted to the shift registers. Therefore, basically, the gate lines 105-1 to **105-*m*** are driven in sequence through the gate buffers by the vertical clocks supplied by the shift register VSR.

In this way, the vertical drive circuit 102 drives the gate lines 105-1 to **105-*m* in sequence for example from the first row. Along with this, the storage lines 106-1 to 106-*m* are driven. At this time, one gate line is driven by the gate pulse, then the levels of the storage signals CS1 to CSm applied to the storage lines 106-1 to 106-*m* at the timing of the rising edge of the gate pulse of the next gate line are selected alternately and applied at the first level CSH and the second level CSL. For example, in the case where the first level CSH is selected and the storage signal CS1 is applied to the storage line 106-1 of the first row, the second level CSL is selected and the storage signal CS2 is applied to the storage line 106-2 of the second row, the first level CSH is selected and the storage signal CS3 is applied in the storage line 106-3 of the third row, and the second level CSL is selected and the storage signal CS4 is applied in the storage line 106-4 of the fourth row. In the same way below, the first level CSH and the second level CSL are alternately selected and the storage signals CS5 to CSm are applied to the storage lines 106-5 to 106-*m*. The storage signal is therefore corrected taking into account the optical characteristics so as to give the desired potential based on the potential of the dummy pixel section 108 detected by the detection circuit 109**.

Further, the alternate common voltage Vcom of the small amplitude ΔVcom is applied in common to the second pixel electrodes of the liquid crystal cells LC201 of all the pixel circuits PXLC of the effective pixel section 101.

Further, the horizontal drive circuit 103 receives a horizontal start pulse HST instructing the start of a horizontal scan and horizontal clocks HCK and HCKX with opposite phases serving as the reference for the horizontal scan generated by a not shown clock generator, generates a sampling pulse, successively samples the input video signal in response to the generated sample pulse, and supplies the results to the signal line 107-1 to **107-*n*** as data signals SDT to be written in the pixel circuits PXLC. For example, first, the R-use selector switch is controlled to the conductive state and the R data is output to the signal lines and written. When the write operation of the R data ends, only the G-use selector switch is controlled to the conductive state and the G data is output to the signal lines and written. When the write operation of the G data ends, only the B-use selector switch is controlled to the conductive state and the B data is output to the signal lines and written.

In the present embodiment, after the write operation from this signal line (after the trailing edge of the gate pulse GP), the pixel potential (the potential of the node ND201) is changed by coupling through the storage capacitor CS201 from the storage lines 106-1 to **106-*m***, and the voltage applied to the liquid crystal is modulated. At this time, the common voltage Vcom is supplied as an alternate signal by a small amplitude (10 mV to 1.0V) and not as a constant value. By this, not only the black luminance but also the white luminance is optimized.

As explained above, the present embodiment has a effective pixel section 101 comprised of a plurality of pixel circuits PXLC, each writing video pixel data through a TFT 201, arrayed in a matrix, gate lines 105-1 to **105-*m* positioned so as to correspond to the array of rows of the pixel circuits, a plurality of capacity lines 106-1 to 106-*m* positioned so as to correspond to the array of rows of the pixel circuits, signal lines 107-1 to 107-*m* positioned so as to correspond to the array of columns of the pixel circuit, a vertical drive circuit 102 selectively driving the gate lines and capacity lines, and a generation circuit 104 generating a common voltage signal of a small amplitude which switches in the level at a predetermined cycle, each pixel circuit containing a liquid crystal cell LC201 having a first pixel electrode and second pixel electrode and a storage capacitor CS201** having a first electrode and second electrode. The first pixel electrode of the liquid crystal cell, the first electrode of the storage capacitor, and one terminal of the TFT are connected. A second electrode of the storage capacitor is connected to the capacity line arrayed in the corresponding row. The common voltage signal is applied to the second pixel electrode of the liquid crystal cell. Therefore, both black luminance and white luminance can be optimized. As a result, there is the advantage of being able to optimize the contrast.

Note that in the above embodiment, the explanation was given of the case of application of the invention to a liquid crystal display device mounting an analog interface drive circuit receiving as input an analog video signal, latching this, then successively writing the analog video signal in the pixels in points, but the invention can be similarly applied to a liquid crystal display device mounting a drive circuit receiving as input a digital video signal and writing the video signal in the pixels in lines by the selector unit.

Further, in the above embodiment, the explanation was given of the case of application of the invention to an active matrix-type liquid crystal display device using liquid crystal cells as the display elements (electrooptic elements) of the pixels, but to invention is not limited to a liquid crystal display device. It may also be applied generally to active matrix type display devices such as active matrix type electroluminescence (EL) display devices using EL elements as the display element of the pixels. The display device according to the embodiment explained above can also be used for display panels of direct viewing type video display devices (liquid crystal monitors and liquid crystal viewfinders) and projection type liquid crystal display devices (liquid crystal projectors), that is, liquid crystal display (LCD) panels.

Second Embodiment

Next, one feature of the present invention, that is, the correction of the storage signal CS by the correction circuit 109 shown in FIG. 6 so as to optimize the optical characteristics so that the pixel potential detected from the detection area 108 comprised of the dummy pixel section (monitor section) becomes any desired potential will be explained by a specific example of the configuration.

In the present embodiment, fluctuations in the dielectric constant of the liquid crystals due to changes in the drive temperature and fluctuations in the thickness of the insulating film forming the storage capacitor CS201 and fluctuations in the liquid crystal cell cap due to fluctuations in mass production cause the voltage applied to the liquid crystals to fluctuate. This amount of fluctuation is detected electrically. The fluctuations in the voltage applied to the liquid crystals are suppressed in order to suppress changes due to the temperature of the display or variations at the time of mass production.

The reason for employing this correction circuit unit for optimizing the optical characteristics will be explained with reference to a model equation of the effective pixel voltage.

Equation (6) is a model equation of the effective pixel voltage of a general 1H Vcom inverted drive unit. As shown by the second term at the bottom in equation (6), even if the Ccs (CS capacity) and Clc (liquid crystal capacity) change, the numerator and denominator are the same, so it will be understood that the voltage applied to the liquid crystals (ΔVpix) will not change. That is, this means that even if fluctuation occurs in the thickness of the gate insulating film, which is a factor changing the Ccs, fluctuation occurs in the gap between liquid crystal layers, which is a factor changing the Clc, of a change occurs in the dielectric constant due to a temperature change, the voltage applied to the liquid crystals will not change.

$$\Delta Vpix = Vsig + \frac{Ccs + Clc}{Ccs + Clc + Cg + Csp} * \Delta Vcom - Vcom \approx Vsig + \frac{Ccs + Clc}{Ccs + Clc} * \Delta Vcom - Vcom \quad (6)$$

The following equation (7) is a model equation of the case of capacity coupling driving. Since the numerator and denominator are different in the second term in equation (7), it will be understood that the above-mentioned fluctuations and changes will be felt. This problem is attempted to be solved by correcting the change in the capacity of the term in question in equation (7). In the present embodiment, the value of Δvcs is changed (corrected) to maintain the value of the term in question constant.

$$\Delta Vpix = Vsig + \frac{Ccs}{Ccs + Clc + Cg + Csp} * \Delta Vcs - Vcom \approx Vsig + \frac{Ccs}{Ccs + Clc} * \Delta Vcs - Vcom \quad (7)$$

This disadvantage in a liquid crystal drive unit utilizing coupling from the capacity line means that conversely the potential difference of the capacity line can be utilized to freely change the change in luminance. In the present embodiment, a dummy pixel (sensor pixel) is provided for monitoring fluctuations and changes in the liquid crystal panel at the time of mass production and the time of temperature changes and the changes are detected so as to realize a liquid crystal display device in which the potential of the capacity line or reference driver can be corrected and the luminance can be optimized (correct).

That is, according to the present embodiment, by providing a dummy pixel (sensor pixel) in the liquid crystal panel for monitoring fluctuations and changes at the time of mass production and at the time of temperature changes and detecting the changes, there is the advantage that it is possible to correct the potential of the capacity line or the reference driver to thereby optimize (correct) the luminance.

Note that the reference driver not shown in FIG. 6 functions as a shade voltage generation circuit generating video pixel data to be propagated along the signal line.

Figure 1:
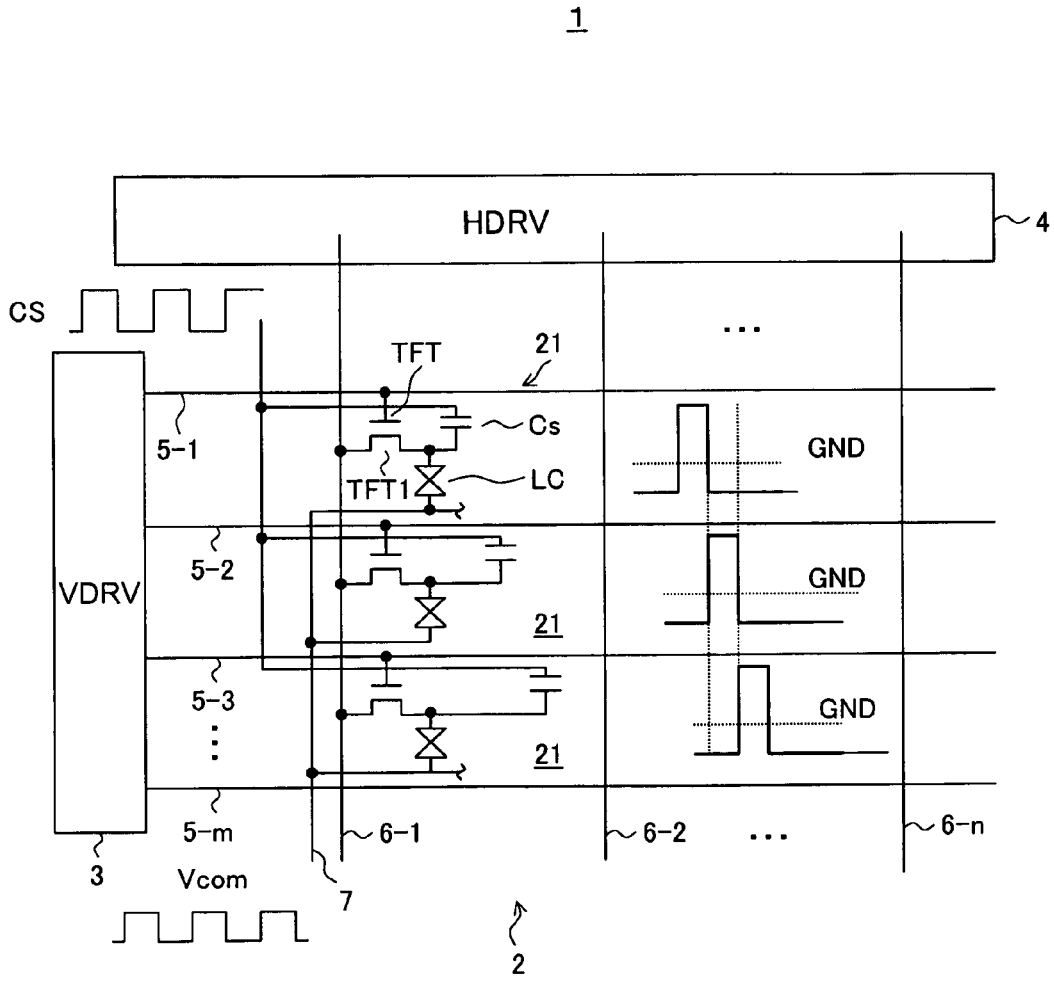
FIG. 1 is a block diagram showing an example of the configuration of a general liquid crystal display device.
Figure 4:
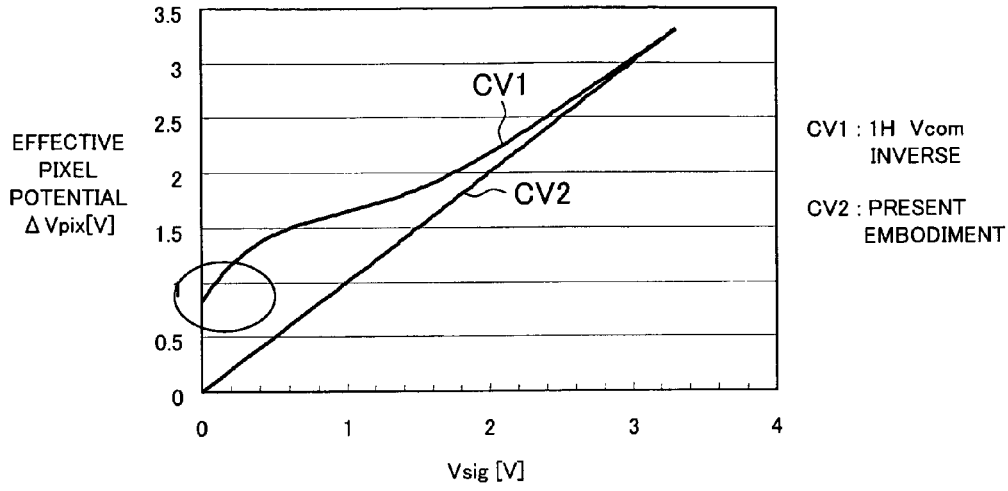
FIG. 4 is a graph showing the relation between the video signal voltages of liquid crystal display devices employing the 1H Vcom inversion drive unit and the related capacity coupling drive unit and the effective pixel potential.
Figure 5:
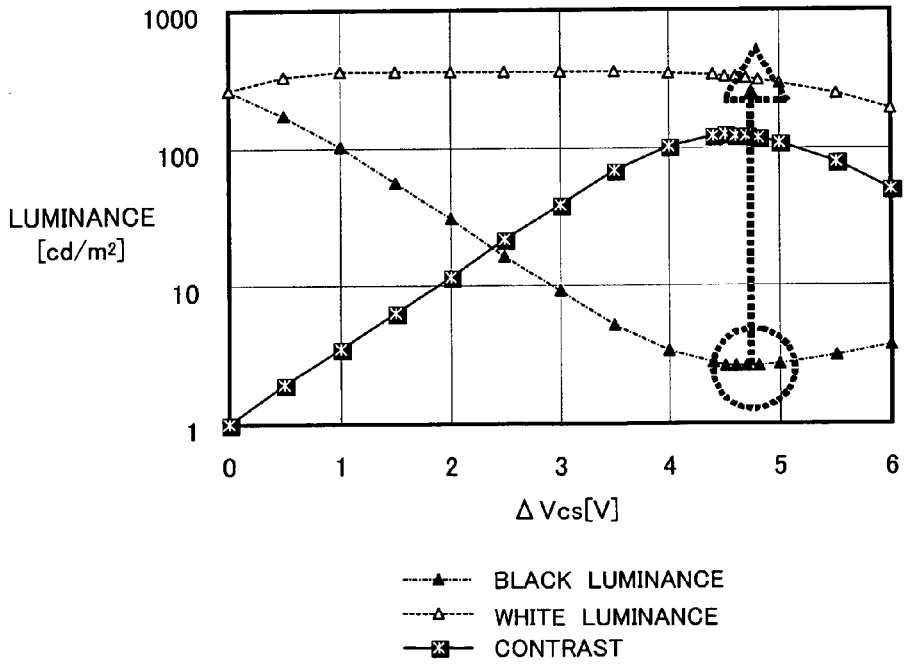
FIG. 5 is a graph showing the blackening (dropping) of the white luminance when optimizing the black luminance of a liquid crystal display device employing the related capacity coupling drive unit.

Basically, during actual drive operation, the potential of a pixel or monitor use dummy pixel placed on the glass substrate is detected and the CS potential ΔVcs (FIG. 5) is fed back to a not shown reference driver so as to optimize the optical properties. Further, for production variations, the same effect is obtained as with manual adjustments at the time of the inspection process.

In the present embodiment, the CS potential ΔVcs is not made a constant value. For example, it is changed by a correction circuit unit formed on the glass substrate or a circuit unit formed on the single crystal Si so as to improve the optical properties. Note that a similar effect can be obtained by adjustment in the inspection process.

FIG. 6 showed an example of the unit configuration. Below, examples of unit configurations tailored to actual use will be explained with reference to FIG. 15 to FIG. 20.

Figure 15:
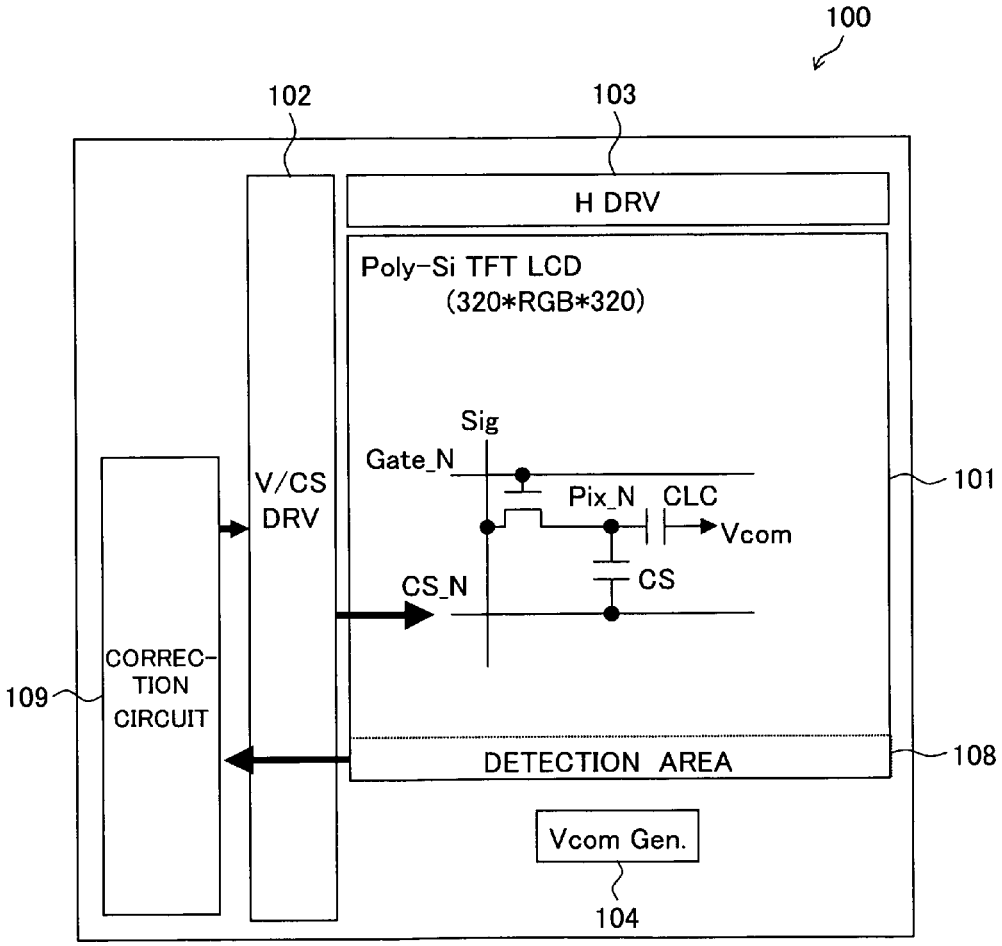
FIG. 15 is a view of an example of formation of a detection area and correction circuit unit on a unit on glass panel according to a display device of the present embodiment.

FIG. 15 shows a display device according to the present embodiment wherein the detection area 108 and correction circuit 109 are formed on a unit-on-glass panel. In this case, changes in the liquid crystal cap, gate oxide film, liquid crystal relative dielectric constant, etc. occurring in the detection area 108 arranged in the effective pixel section 101 or its adjoining regions are detected by the correction circuit 109 and fed back to the CS potential ΔVcs for correcting the ΔVcs so that the optical properties become optimal.

Figure 16:
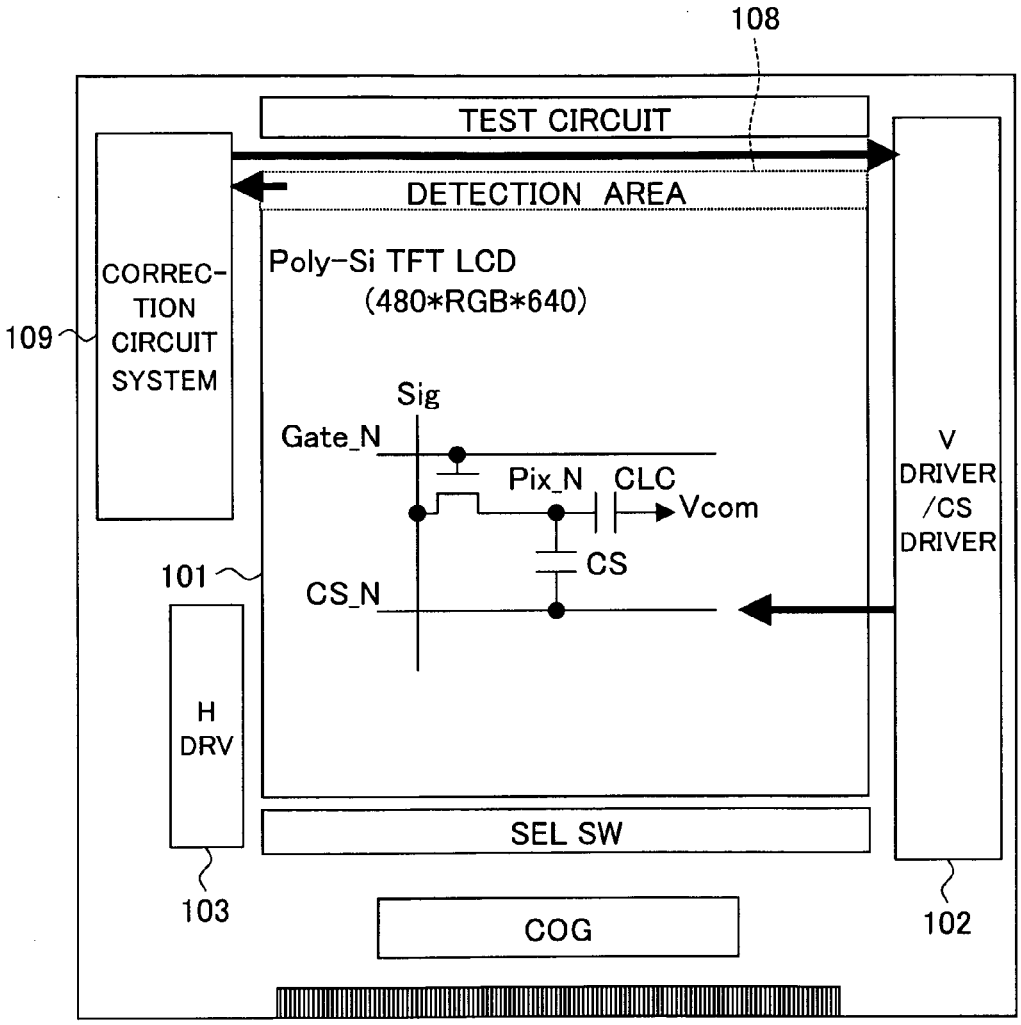
FIG. 16 is a view of an example of formation of a detection area and correction circuit unit on a COG panel according to a display device of the present embodiment.

FIG. 16 shows a display device according to the present embodiment wherein the detection area 108 and correction circuit 109 are formed on a COG panel. In this case as well, changes in the liquid crystal cap, gate oxide film, liquid crystal relative dielectric constant, etc. occurring in the detection area 108 arranged in the effective pixel section 101 or its adjoining regions are detected by the correction circuit 109 and fed back to the CS potential ΔVcs for correcting the ΔVcs so that the optical properties become optimal.

Figure 17:
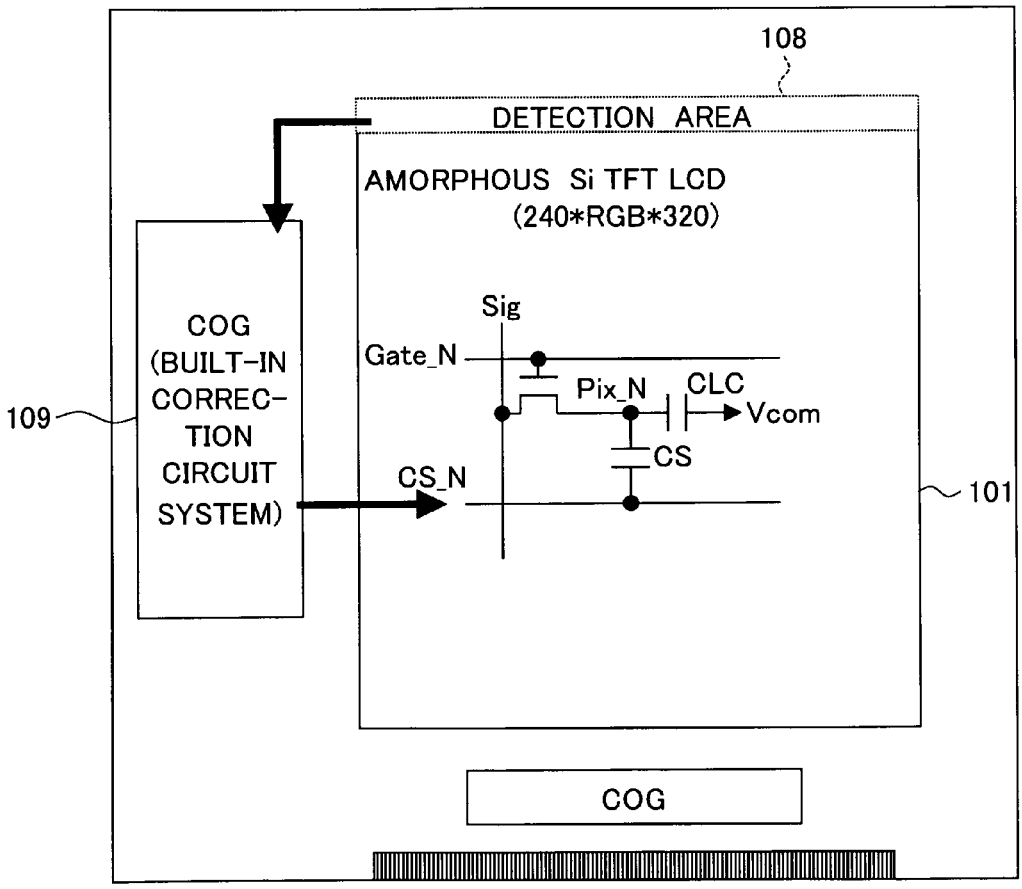
FIG. 17 is a view of an example of formation of a detection area on a panel and a correction circuit unit in a single crystal LSI according to a display device of the present embodiment.

FIG. 17 shows a display device according to the present embodiment wherein the detection area 108 is formed on the panel and is the correction circuit 109 formed in the single crystal LSI. In this case as well, changes in the liquid crystal cap, gate oxide film, liquid crystal relative dielectric constant, etc. occurring in the detection area 108 arranged in the effective pixel section 101 or its adjoining regions are detected by the correction circuit 109 and fed back to the CS potential ΔVcs for correcting the ΔVcs so that the optical properties become optimal.

Figure 18:
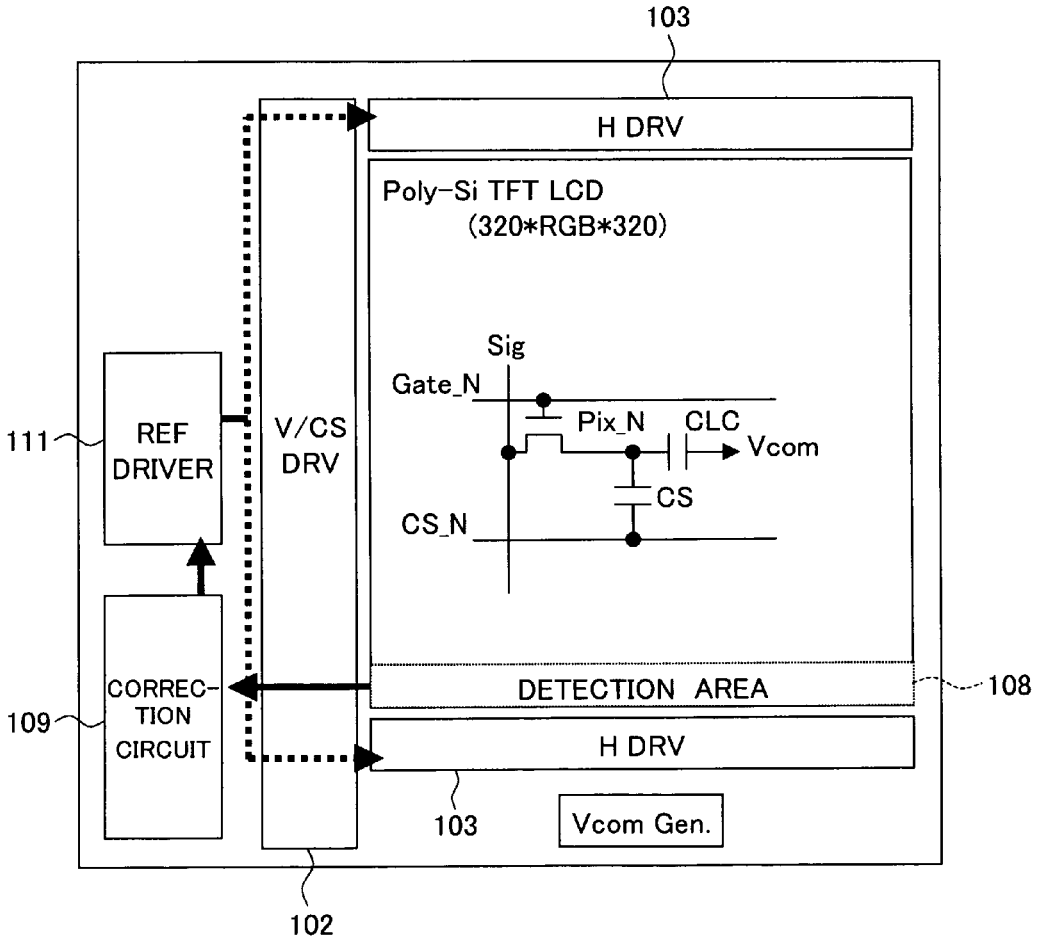
FIG. 18 is a view of a second example of formation of a detection area and correction circuit unit on a unit on glass panel according to a display device of the present embodiment.

FIG. 18 shows a second example of display device according to the present embodiment wherein the detection area 108 and correction circuit 109 are formed on a unit-on-glass panel. In this case, changes in the liquid crystal cap, gate oxide film, liquid crystal relative dielectric constant, etc. occurring in the detection area 108 arranged in the effective pixel section 101 or its adjoining regions are detected by the correction circuit 109 and fed back to the reference driver 111 so that the optical properties become optimal. In this case, the correction circuit 109 corrects the signal voltage of the reference driver 111 generating the video pixel data.

Figure 19:
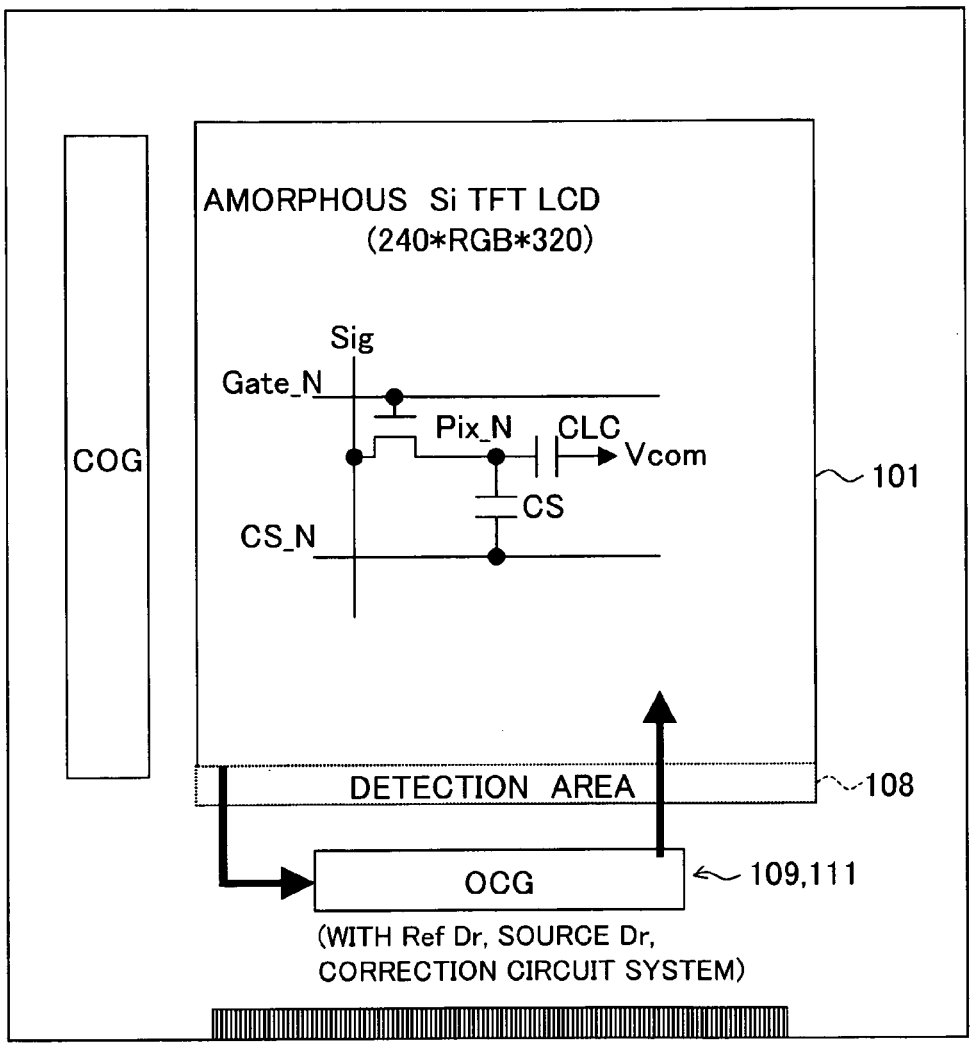
FIG. 19 is a view of a second example of formation of a detection area and correction circuit unit on a COG panel according to a display device of the present embodiment.

FIG. 19 shows a second example of a display device according to the present embodiment wherein the detection area 108 and correction circuit 109 are formed on a COG panel. In this case as well, changes in the liquid crystal cap, gate oxide film, liquid crystal relative dielectric constant, etc. occurring in the detection area 108 arranged in the effective pixel section 101 or its adjoining regions are detected by the correction circuit 109 and fed back to the reference driver 111 so that the optical properties become optimal.

Figure 20:
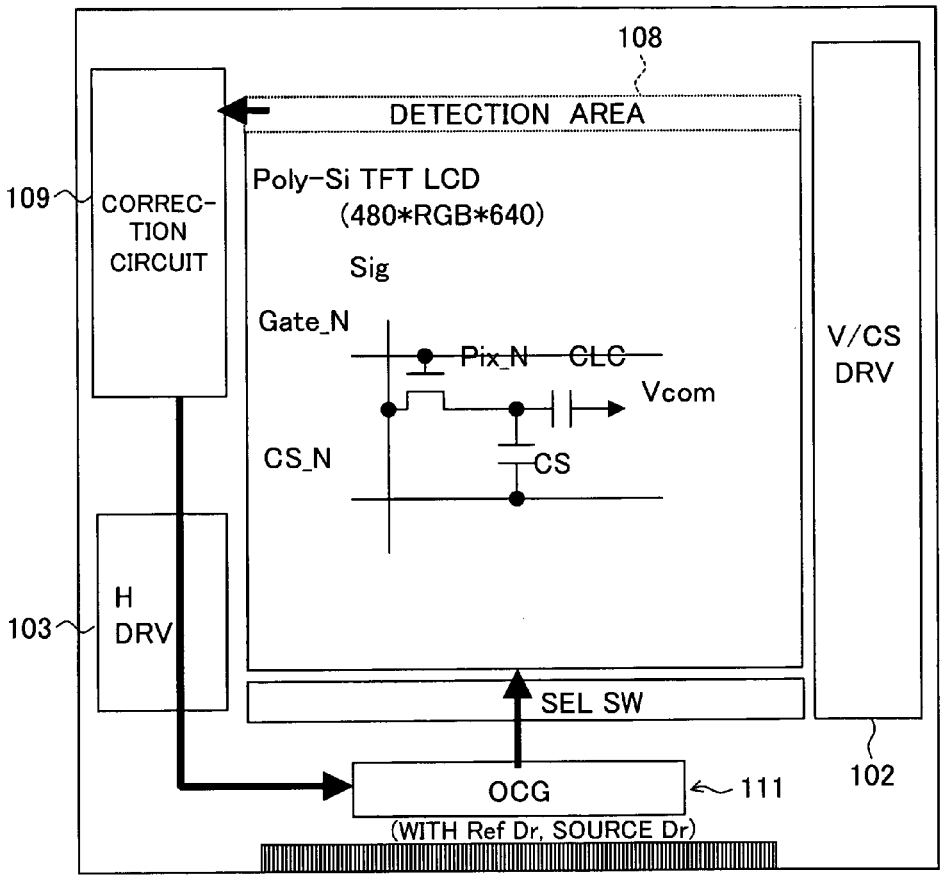
FIG. 20 is a view of a second example of formation of a detection area on a panel and a correction circuit unit in a single crystal LSI according to a display device of the present embodiment.

FIG. 20 is a view showing a second example of a display device according to the present embodiment wherein the detection area 108 is formed on the panel and the correction circuit 109 is formed in the single crystal LSI in. In this case as well, changes in the liquid crystal cap, gate oxide film, liquid crystal relative dielectric constant, etc. occurring in the detection area 108 arranged in the effective pixel section 101 or its adjoining regions are detected by the correction circuit 109 and fed back to the reference driver 111 so that the optical properties become optimal.

Next, the configuration and functions of the monitor use dummy pixel section and the correction circuit unit included in the detection area 108 will be explained in detail.

Figure 21:
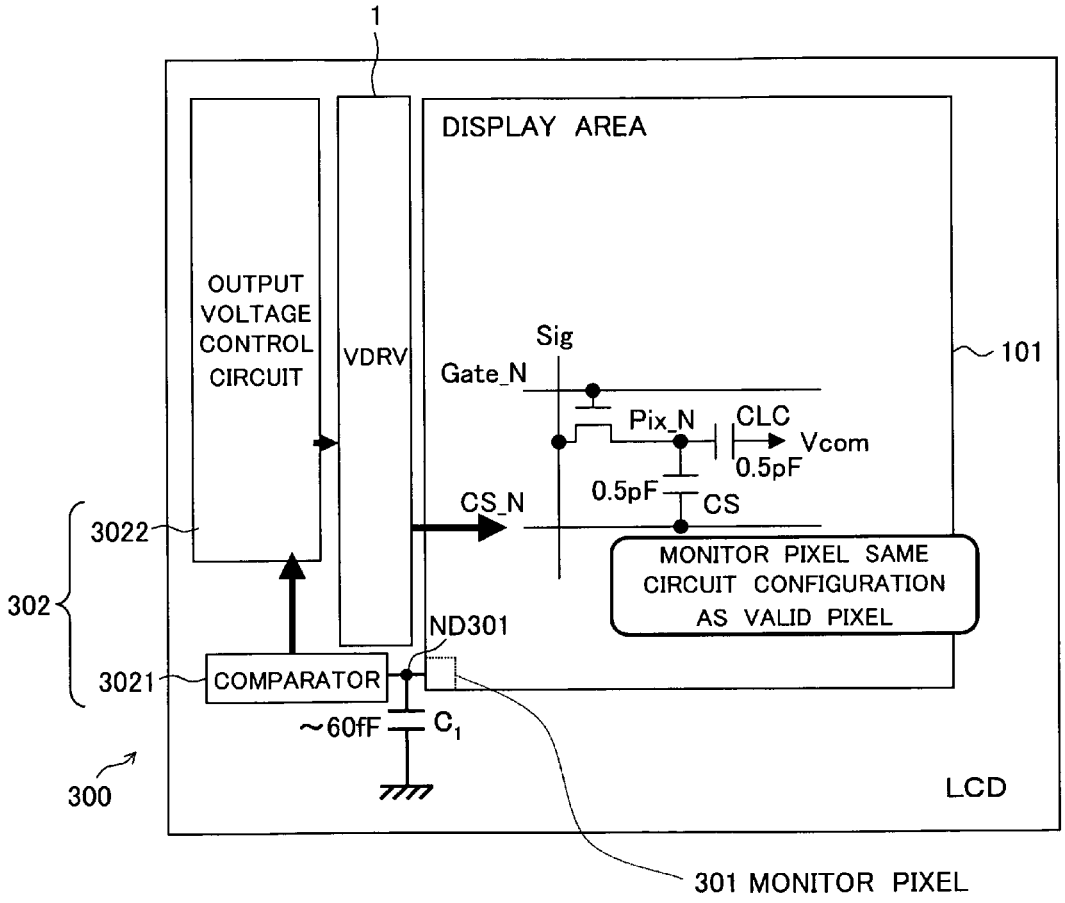
FIG. 21 is a view of a first example of the configuration of a correction circuit unit according to the present embodiment.
Figure 22:
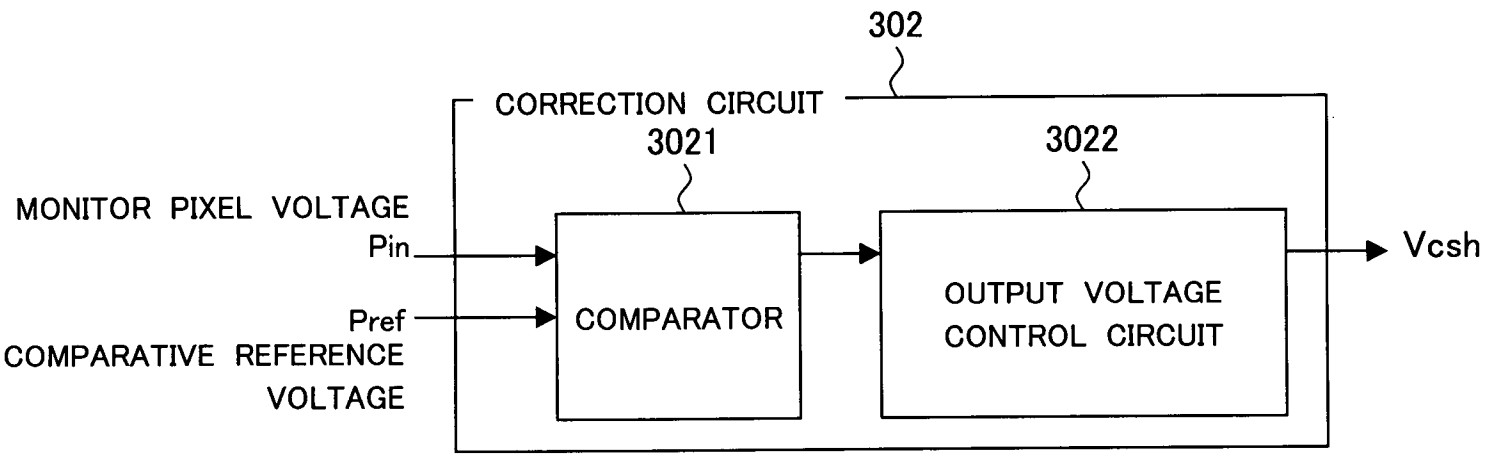
FIG. 22 is a view illustrating a basic configuration of the correction circuit unit shown in FIG. 21.

FIG. 21 is a diagram showing a first example of the configuration of a correction circuit unit according to the present embodiment. Note that in FIG. 21, to facilitate understanding, only the correction circuit unit and the effective pixel section are shown. Further, FIG. 22 is a block diagram showing the basic configuration of the correction circuit of FIG. 21.

The correction circuit unit 300 of FIG. 21 is comprised of one dummy pixel 301 and a correction circuit 302 (in FIG. 6, shown by reference numeral 109) formed in the same device (panel). In this case, for example, by using a low temperature polysilicon process, the correction circuit 302 can be built into the device. The dummy (monitor) pixel 301 has a circuit configuration similar to the effective pixel circuit PXLC of the effective pixel section 101. The correction circuit 302 has a comparator 3021 for comparing the monitor pixel voltage Pin and a comparative reference voltage Pref and an output voltage control circuit 3022 outputting a signal Vcsh for controlling the CS potential ΔVcs to be optimized in accordance with the results of comparison of the CS comparator 3021 to the power source unit of the CS driver of the vertical drive circuit 102. Further, in the circuit unit 300 of FIG. 19, the dummy pixel 301 and the comparator 3021 of the correction circuit 300 are arranged in close proximity.

In this case, for example, if the storage capacity Cs of the dummy pixel 301 is made 0.5 pF, the liquid crystal capacity Clc is made 0.5 pF (that is, the storage capacity of the dummy pixel is made 1.0 pF), the parasitic capacitance C1 of the connection node ND301 between the dummy pixel 301 and the comparator 3021 is made 0.06 pF, the charge voltage Vcs of the storage line is made 3.3V, the video signal voltage Vsig is made 3.3V, and Vcom is made 1.65V, the effective pixel potential Vp becomes, as in the following equation, 3.21V. There is only a 90 mV or so voltage drop, so a good monitor pixel potential can be obtained.

$$Vp = Vsig + \frac{Vcs \times Cs}{Cs + Clc + C_1} - 1.65\ \text{V} \tag{8}$$

*Expressed with respect to *GND*

$$Vp = 3.3\ \text{V} + \frac{3.3\ \text{V} \times 0.5\ \text{pF}}{0.5\ \text{pF} + 0.5\ \text{pF} + 0.06\ \text{pF}} - 1.65\ \text{V} = \underline{3.21\ \text{V}} \tag{9}$$

Figure 23:
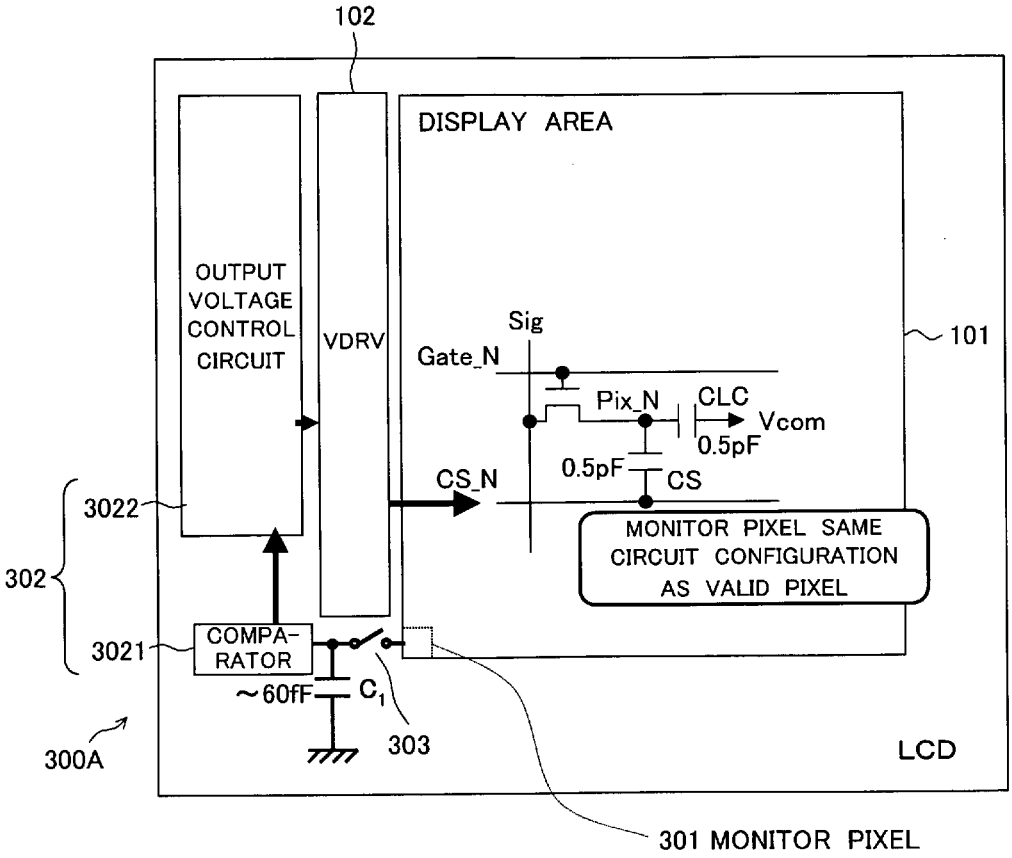
FIG. 23 is a view of a second example of the configuration of a correction circuit unit according to the present embodiment.

FIG. 23 is a view of a second example of the configuration of a correction circuit according to the present embodiment. Note that in FIG. 23, to facilitate understanding, only the correction circuit unit and the effective pixel section are illustrated.

The correction circuit unit 300A of the second example of configuration differs from the correction circuit unit 300 of FIG. 21 in the provision of a switch 303 in the connection line between the dummy pixel 301 and the comparator 3021 (for example, the output part to the pixel potential of the dummy pixel) for selectively outputting the pixel potential. In this case, the monitor pixel potential Vpin is given by the next equation (equation 10).

$$Vpin = \frac{Vp \times (Cs + Clc) + V_1 \times C_1}{Cs + Clc + C_1} \tag{10}$$

Further, as explained above, if the storage capacity Cs of the dummy pixel 301 is made 0.5 pF, the liquid crystal capacity Clc is made 0.5 pF (that is, the storage capacity of the dummy pixel is made 1.0 pF), the parasitic capacitance C1 of the connection node ND301 between the dummy pixel 301 and the comparator 3021 is made 0.06 pF, the charge voltage Vcs of the storage line is made 3.3V, the video signal voltage Vsig is made 3.3V, and Vcom is made 1.65V, the effective pixel potential Vp becomes, as in the following equation (equation 11), 3.28V. There is only a 20 mV or so voltage drop, so a good monitor pixel potential can be obtained.

$$Vpin = \frac{3.3\ \text{V} \times 1\ \text{pF} + 3.0\ \text{V} \times 0.06\ \text{pF}}{1.06\ \text{pF}} = \underline{3.28\ \text{V}} \tag{11}$$

Next, the configuration and functions of the monitor use dummy pixel section and the correction circuit unit included in the detection area 108 will be explained in detail.

By providing the switch 303 in this way so as to reduce the effect of the parasitic capacitance C1 to a minimum, a better monitor pixel potential can be obtained.

Note that it is also possible to provide the connection line between the dummy pixel 301 and the comparator 3021 with for example a precharge circuit or reset circuit and discharge the parasitic capacitance to a certain extent, then turn the switch 303 on and compare the monitor pixel potential Vpin and the reference potential by the comparator 3021.

Above, the correction circuit 302 was formed in the same device as the dummy pixel 301 and arranged in proximity to it. Below, the case where the correction circuit 302 is mounted on an external board will be considered.

Figure 24:
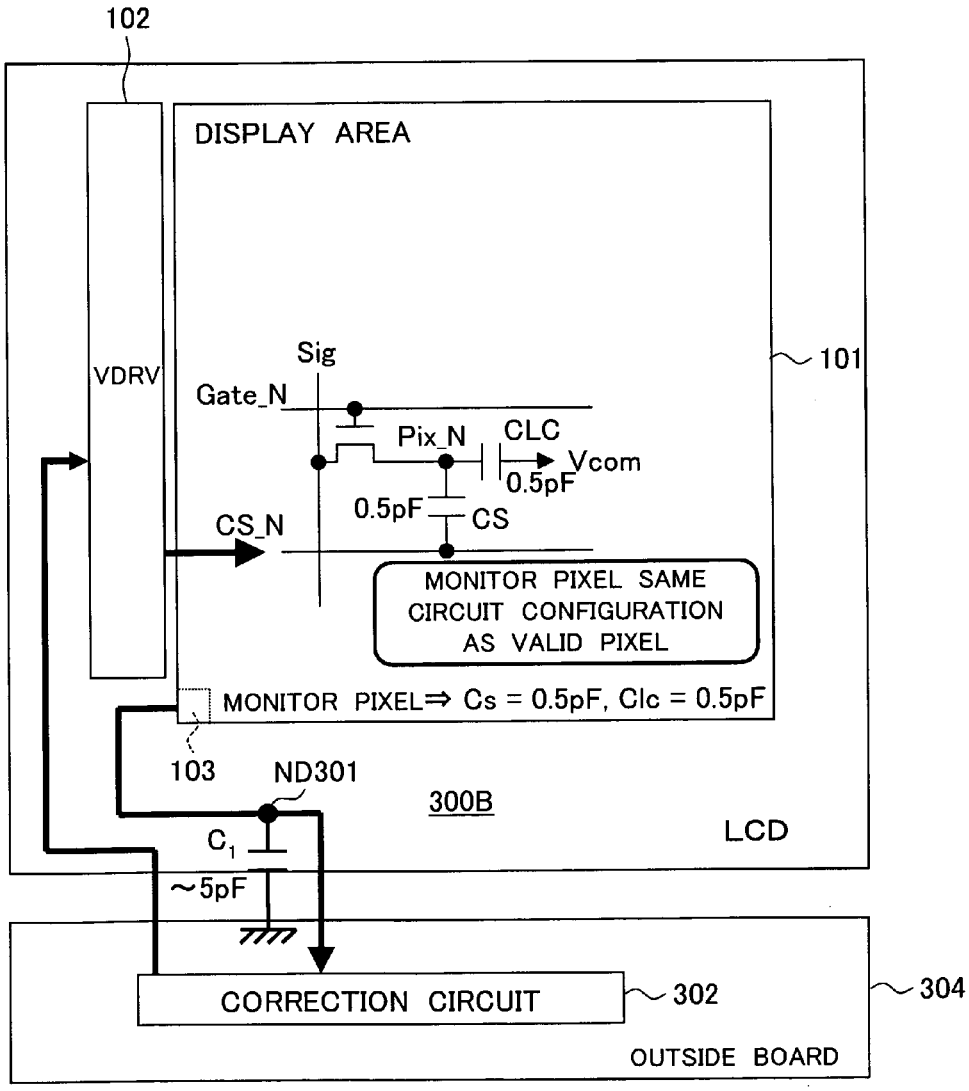
FIG. 24 is a view of a third example of the configuration of a correction circuit unit according to the present embodiment.

FIG. 24 is a view of a third example of configuration of a correction circuit unit according to the present embodiment. Note that, in FIG. 24, to facilitate understanding, only the correction circuit unit and the effective pixel section are shown.

The correction circuit unit 300B of this third example of the configuration has a circuit configuration equivalent to that of FIG. 21 but with the correction circuit transferred to an external board 304.

In this case, for example, if the storage capacity Cs of the dummy pixel 301 is made 0.5 pF, the liquid crystal capacity Clc is made 0.5 pF (that is, the storage capacity of the dummy pixel is made 1.0 pF), the parasitic capacitance C1 of the connection node ND301 between the dummy pixel 301 and the comparator 3021 is made 0.06 pF, the charge voltage Vcs of the storage line is made 3.3V, the video signal voltage Vsig is made 3.3V, and Vcom is made 1.65V, the effective pixel potential Vp becomes, as in the following equation (equation 12), 1.925V. That is, the potential of Vp is ideally 3.3V, while in the configuration of FIG. 22, it is 1.925V for a 1300 mV or so voltage drop, so it is difficult to say that a good monitor pixel potential can be obtained.

$$Vp = 3.3\ \text{V} + \frac{3.3\ \text{V} \times 0.5\ \text{pF}}{0.5\ \text{pF} + 0.5\ \text{pF} + 5\ \text{pF}} - 1.65\ \text{V} = \underline{1.925\ \text{V}} \tag{12}$$

Figure 25:
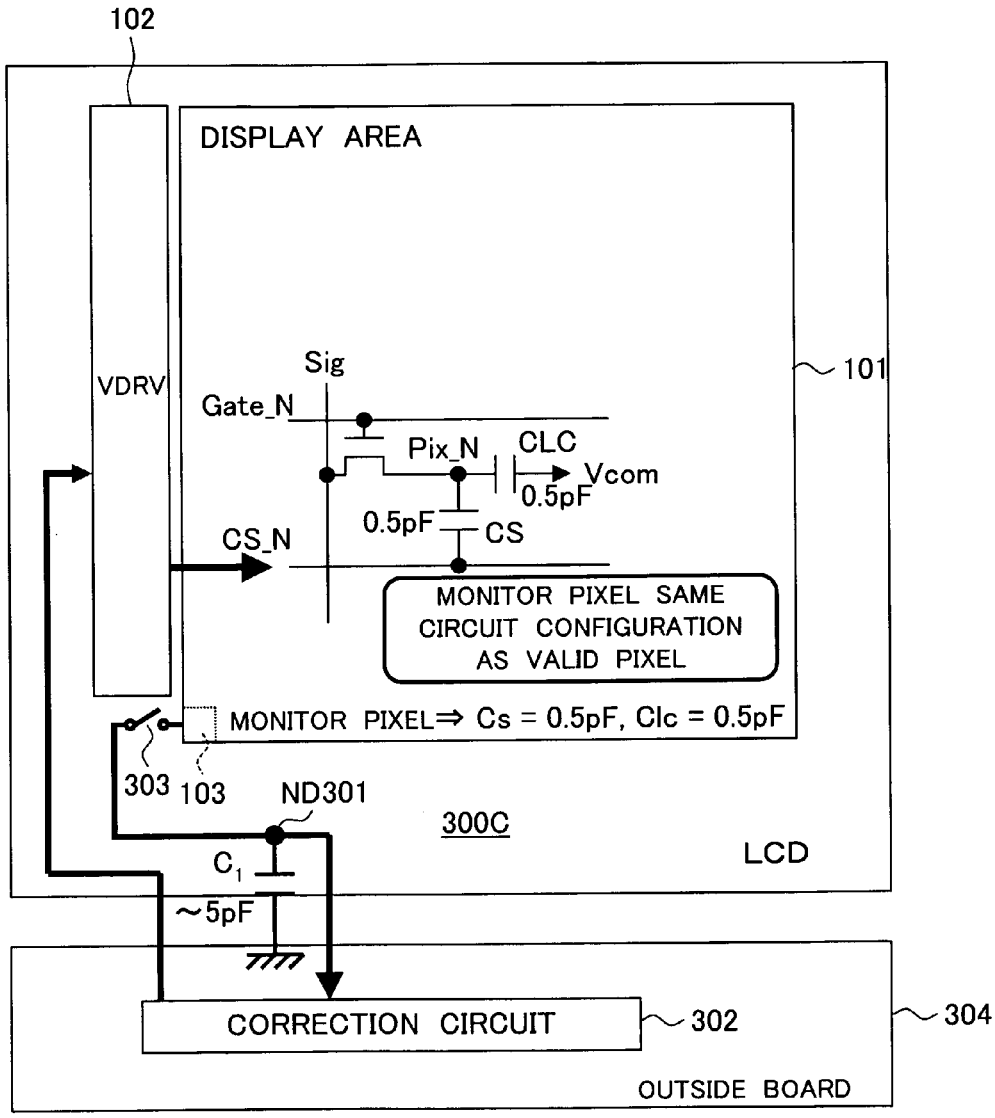
FIG. 25 is a view of a fourth example of the configuration of a correction circuit unit according to the present embodiment.

FIG. 25 is a view of a fourth example of configuration of a correction circuit unit according to the present embodiment. Note that, in FIG. 25, to facilitate understanding, only the correction circuit unit and the effective pixel section are shown.

The correction circuit unit 300C of this fourth example of the configuration has a circuit configuration equivalent to that of FIG. 23 but with the correction circuit 302 transferred to an external board 304. That is, the switch 303 is provided in this configuration.

Further, as explained above, if the storage capacity Cs of the dummy pixel 301 is made 0.5 pF, the liquid crystal capacity Clc is made 0.5 pF (that is, the storage capacity of the dummy pixel is made 1.0 pF), the parasitic capacitance C1 of the connection node ND301 between the dummy pixel 301 and the comparator 3021 is made 0.06 pF, the charge voltage Vcs of the storage line is made 3.3V, and the video signal voltage Vsig is made 3.3V, the effective pixel potential Vp becomes, as in the following equation (equation 12), 3.05V. The voltage drop can be kept down to 250 mV or so as compared with the 1300 mV or so voltage drop, so a good monitor pixel potential able to withstand practical use can be obtained.

$$Vpin = \frac{3.3\ \text{V} \times 1\ \text{pF} + 3.0\ \text{V} \times 5\ \text{pF}}{6\ \text{pF}} = \underline{3.05\ \text{V}} \tag{13}$$

By providing the switch 303 so as to reduce the effect of the parasitic capacitance C1 to a minimum, a good monitor pixel potential can be obtained.

Note that it is also possible to provide the connection line between the dummy pixel 301 and the comparator 3021 with for example a precharge circuit or reset circuit and discharge the parasitic capacitance to a certain extent, then turn the switch 303 on and compare the monitor pixel potential Vpin and the reference potential by the comparator 3021.

Figure 26:
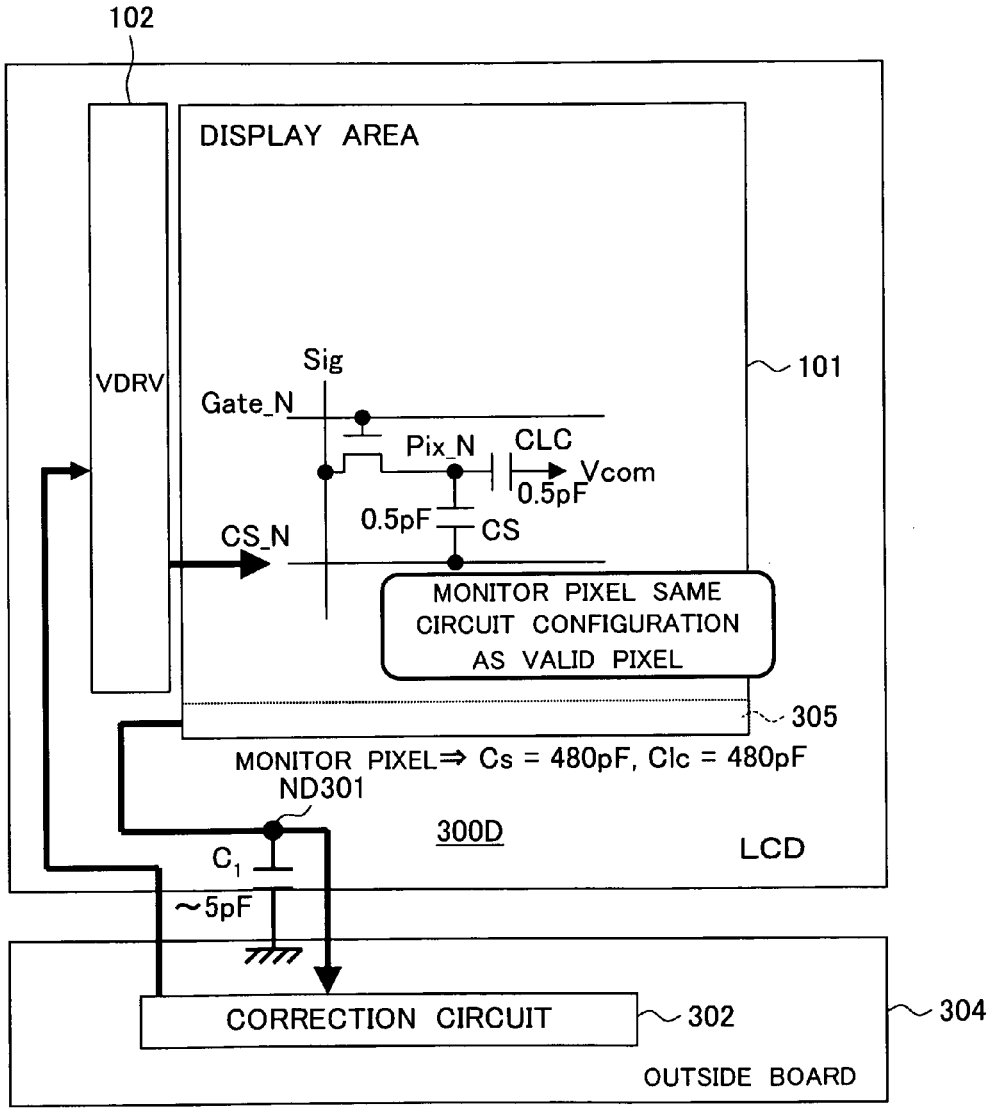
FIG. 26 is a view of a fifth example of the configuration of a correction circuit unit according to the present embodiment.

FIG. 26 is a view of a fifth example of configuration of a correction circuit unit according to the present embodiment. Note that, in FIG. 26, to facilitate understanding, only the correction circuit unit and the effective pixel section are shown.

The correction circuit unit 300D of this fifth example of the configuration differs from the correction circuit unit 300B of FIG. 23 in the point that, as the monitor pixel, instead of providing one dummy pixel 301, as shown in FIG. 25, all dummy pixel electrodes of one line in the horizontal direction are connected so as to increase the overall storage capacity of the monitor pixel 305. If there are 320 horizontal lines, 1 pF×320×3 (RGB)=960 pF. This value is a sufficiently large value compared with the parasitic capacity 1 pF of the connection line.

In this case, for example, if the storage capacity Cs of the dummy pixel 301 is made 0.5 pF, the liquid crystal capacity Clc is made 0.5 pF (that is, the storage capacity of the dummy pixel is made 1.0 pF), the parasitic capacitance C1 of the connection node ND301 between the dummy pixel 301 and the comparator 3021 is made 0.06 pF, the charge voltage Vcs of the storage line is made 3.3V, the video signal voltage Vsig is made 3.3V, and Vcom is made 1.65V, the effective pixel potential Vp becomes, as in the following equation (equation 14), 3.39V. The voltage drop can be kept down to 10 mV or so as compared with the 1300 mV voltage drop, so a good monitor pixel potential can be obtained $$Vp = 3.3\ \text{V} + \frac{3.3\ \text{V} \times 480\ \text{pF}}{480\ \text{pF} + 480\ \text{pF} + 5\ \text{pF}} - 1.65\ \text{V} = \underline{3.29\ \text{V}} \tag{14}$$

Figure 27:
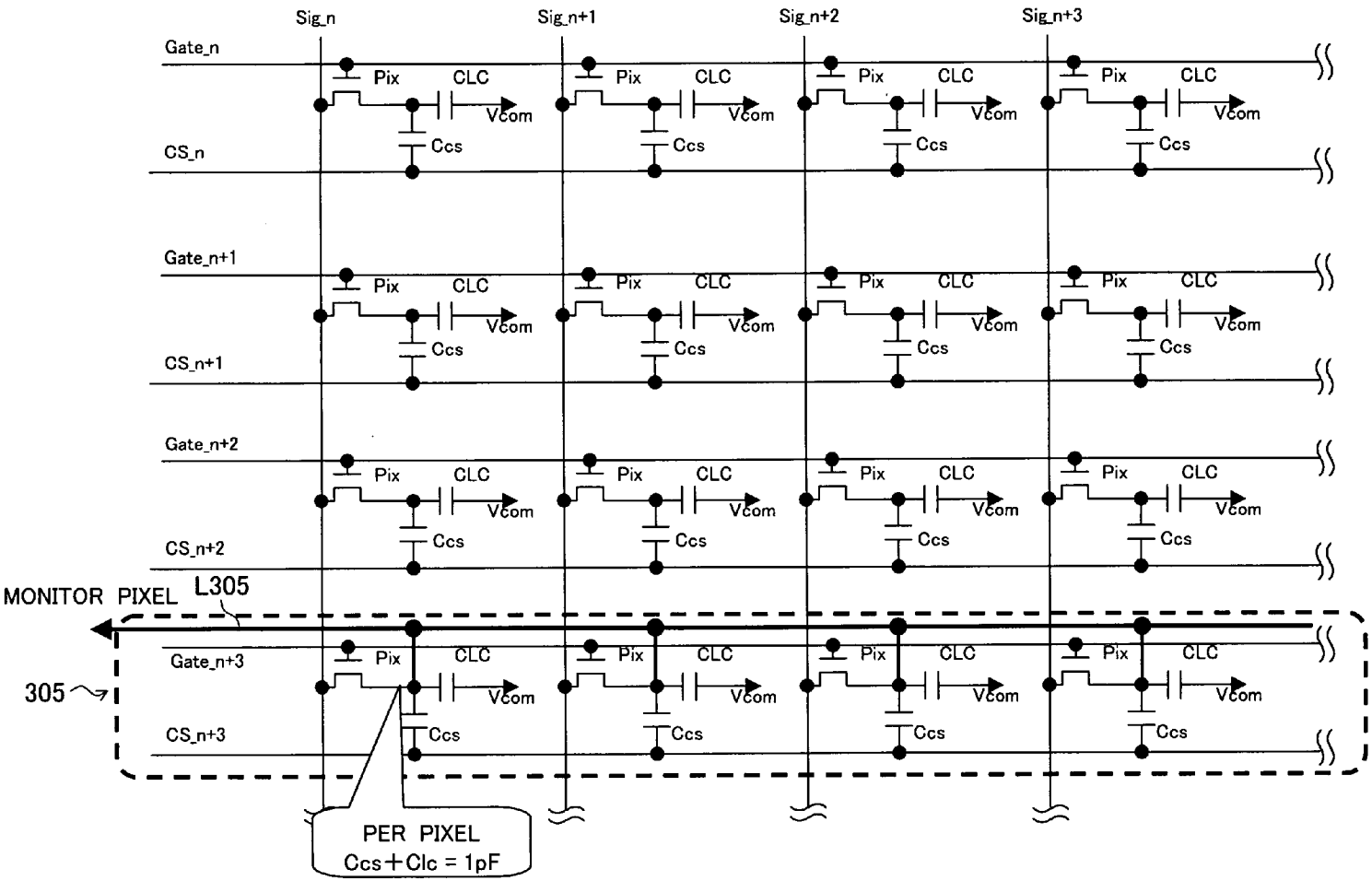
FIG. 27 is a view of an example of a monitor pixel comprised by connecting all dummy pixel electrodes of one line in the horizontal direction.

FIG. 27 is a view of an example of a monitor pixel comprised by connecting all dummy pixel electrodes of one line in the horizontal direction.

Figure 28:
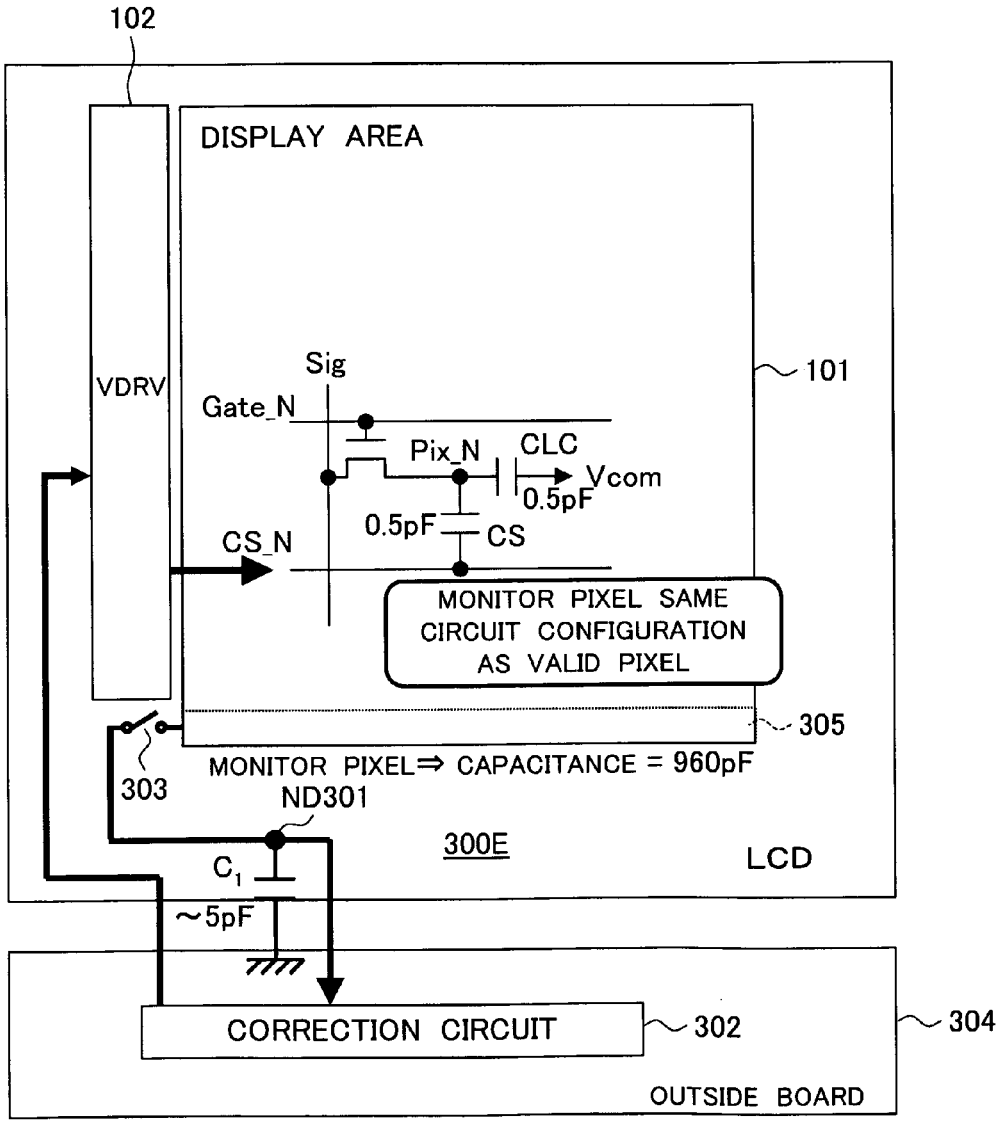
FIG. 28 is a view of a sixth example of the configuration of a correction circuit unit according to the present embodiment.

FIG. 28 is a view of a sixth example of configuration of a correction circuit unit according to the present embodiment. Note that, in FIG. 28, to facilitate understanding, only the correction circuit unit and the effective pixel section are shown.

The correction circuit unit 300E of this sixth example of the configuration differs from the correction circuit unit 300D of FIG. 26 in the point of provision of the switch 303 outside of the monitor pixel 305.

Further, as explained above, if the storage capacity Cs of the dummy pixel 301 is made 0.5 pF, the liquid crystal capacity Clc is made 0.5 pF (that is, the storage capacity of the dummy pixel is made 1.0 pF), the parasitic capacitance C1 of the connection node ND301 between the dummy pixel 301 and the comparator 3021 is made 0.06 pF, the charge voltage Vcs of the storage line is made 3.3V, and the video signal voltage Vsig is made 3.3V, the effective pixel potential Vp becomes, as in the following equation (equation 15), 3.298V. The voltage drop can be reduced from 200 mV or so to 2 mV of so, so a good monitor pixel potential can be obtained.

$$Vpin = \frac{3.3\ \text{V} \times 960\ \text{pF} + 3.0\ \text{V} \times 5\ \text{pF}}{965\ \text{pF}} = \underline{3.298\ \text{V}} \tag{15}$$

Next, the specific circuit configuration of the above-mentioned correction circuit unit 302 will be explained.

Figure 29:
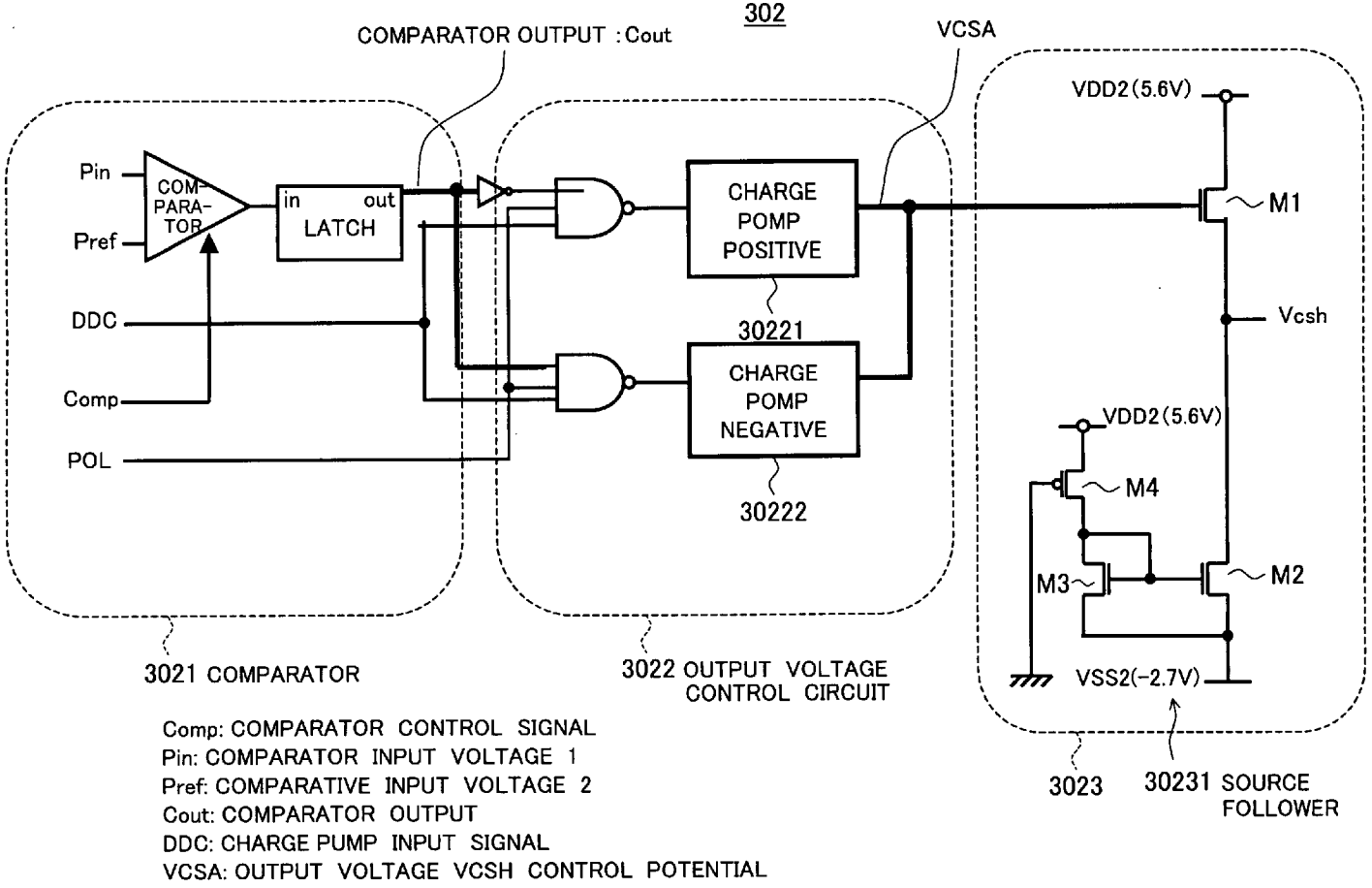
FIG. 29 is a circuit diagram of a specific example of the configuration of the correction circuit according to the present embodiment.
Figure 30:
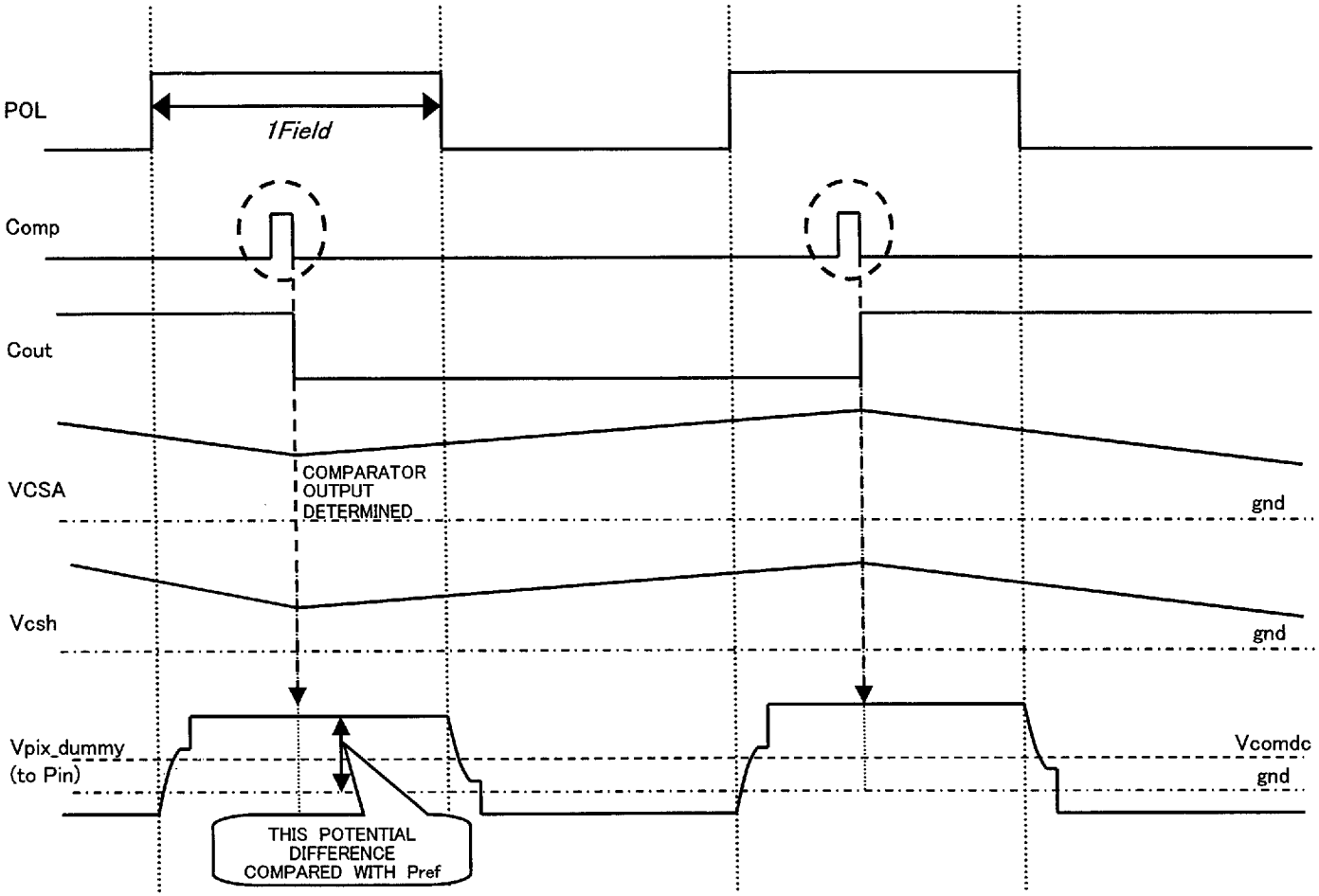
FIG. 30 is a timing chart of the correction circuit of FIG. 29.

FIG. 29 is a circuit diagram showing a specific example of the configuration of the correction circuit according to the present embodiment. Further, FIG. 30 is a timing chart of the correction circuit of FIG. 29.

This correction circuit 302 has a comparator 3021, output voltage control block 3022, and output buffer 3023.

First, the comparator 3021 is comprised of two inputs of the voltages Pin, Pref. The input voltage Pin is connected to the monitor pixel potential. Here, the monitor pixel uses part of the dummy pixel 301 or monitor pixel 305 arranged around an effective pixel as explained above. Due to this, temperature changes and production variations can be detected. Further, as explained above, by making the dummy pixel the same in circuit configuration/structure as an effective pixel, it is possible to more precisely detect the state of the effective pixels. The input voltage Pref may be any reference voltage. The voltage applied to the monitor pixel applies any gradation of voltage. Pref may be set to the voltage to be applied to the monitor pixel. Further, Pref and Pin (monitor pixel potential) are successively compared to detect if the monitor pixel potential is low or higher than Pref and this is reflected back into the output of the comparator. The output of the comparator 3021 is the digital output HorL.

Note that the effective pixel potential and the compared pixel potential Vpix both invert in voltage polarity every other field. However, the comparative reference voltage Pref is a direct current voltage, so compared with comparison every field, mistaken operation ends up occurring. Therefore, the comparator 3021 is operated repeating a valid/invalid period every other field.

The output voltage control block 3022 is configured including a voltage step-up circuit 30221 and a voltage step-down circuit 30222. One circuit is made valid by the output of the comparator 3021 so as to control the voltage applied to the gate of M1. When the output of the comparator is L (low level), the voltage step-up circuit 30221 operates effectively and the voltage step-down circuit 30222 becomes a high impedance (Hi-Z). When the output of the comparator 3021 is H (high level), the voltage step-up circuit 30221 becomes a high impedance (Hi-Z), the voltage step-down circuit 30222 effectively operates, and the voltage VcsA is controlled.

The output buffer 3023 is configured including a M constant current source/Nch source follower 30231. By the voltage VcsA output from the output voltage control block 3022 being supplied to the gate electrode of the Nch transistor M1, the output impedance of the Nch transistor M1 is controlled and, as a result, the output voltage Vcsh is also controlled.

By successively adjusting the Vcsh by the above unit, the detection use dummy pixel potential becomes the same potential as the reference potential Pref applied from the outside and is reflected back into the effective pixel.

The effect of employment of the above correction circuit will be explained next.

In summary, in a display device driving a liquid crystal layer by alternating current, by coupling from the storage line (CS line) through a capacity to change the pixel potential after a write operation from the signal line (after the trailing edge of the gate), the voltage applied to the liquid crystals is modulated. Further, by making the counter electrodes an AC small amplitude, the white luminance/black luminance is optimized.

When displaying an image by this drive operation, the voltage gain Avcs applied from the Cs line is obtained from the following equation:

$$Avcs=Vcs*Ccs/(Ccs+Clc) \quad (16)$$

where,

Ccs: storage capacity per pixel,

Clc: capacity which pixel electrode forms with counter electrode,

Vcs: amplitude potential of Cs line=Vcsh−Vss

Figure 31:
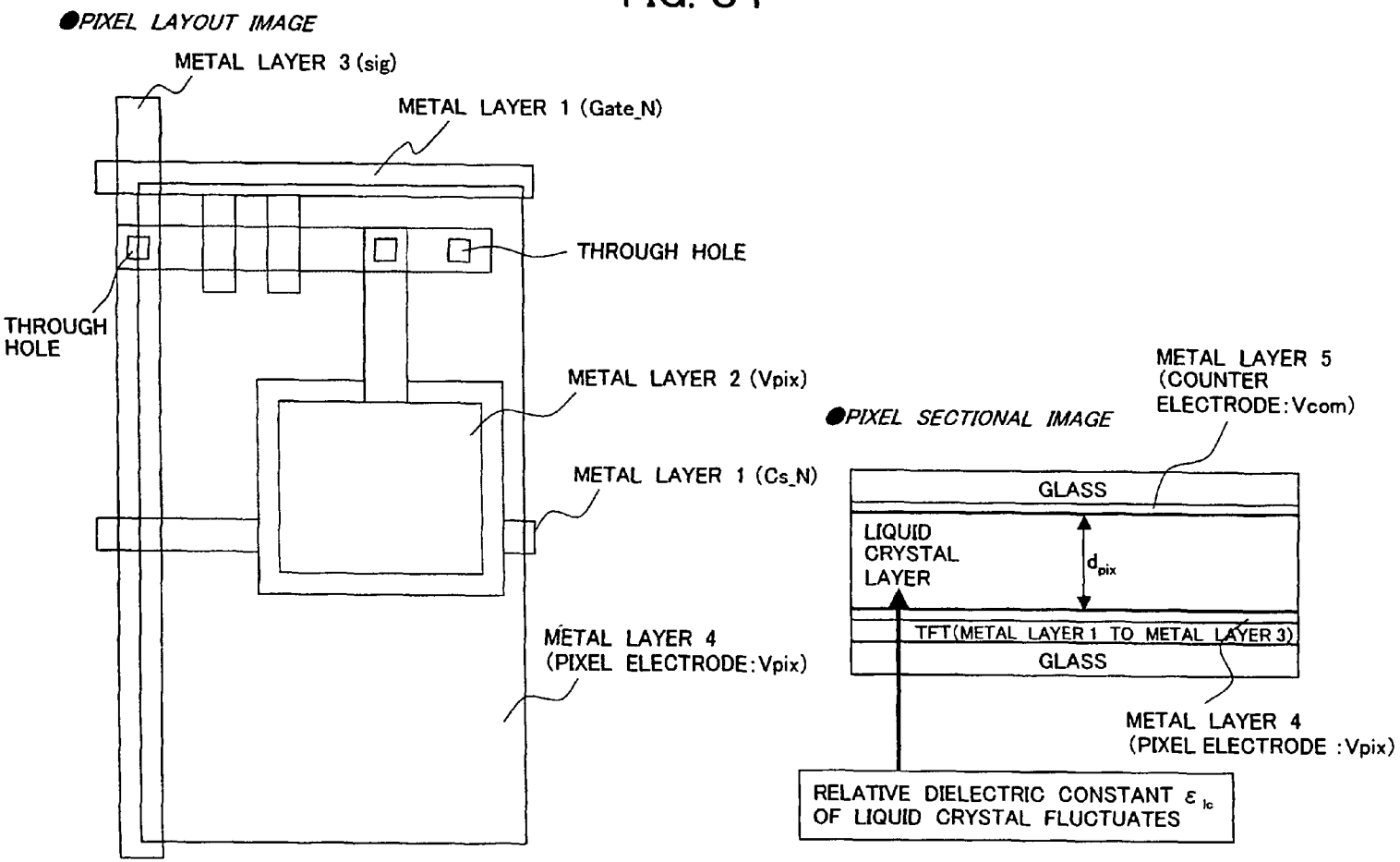
FIG. 31 is a view for explaining the effects of the correction circuit with reference to the pixel structure.
Figure 32:
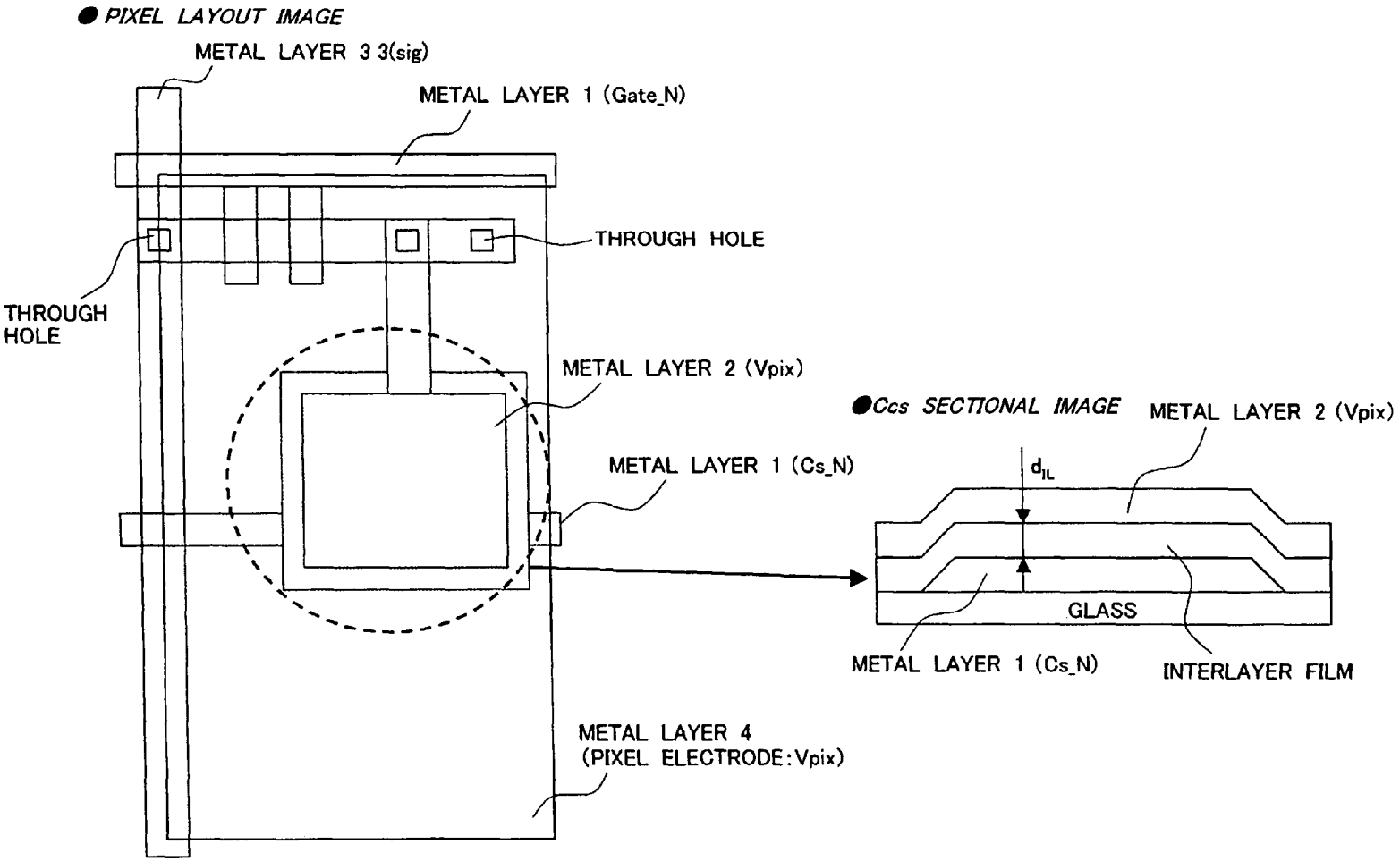
FIG. 32 is a view for explaining the effects of the correction circuit with reference to the pixel structure.
Figure 33A:
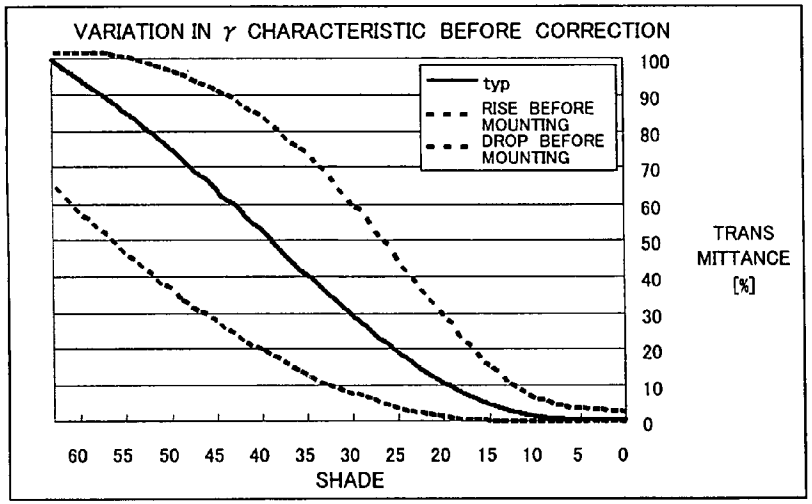
FIG. 33 is a view of the state of fluctuation of the γ (gamma) characteristic from before and after mounting of the correction circuit according to the present embodiment.

The Clc of the above equation is expressed by the following equation:

$$Clc=\epsilon_{lc}*S_{pix}/d_{pix} \quad (17$$

where, $\epsilon_{lc}$: liquid crystal dielectric constant, $S_{pix}$: pixel electrode area per pixel, $d_{pix}$: cap between counter electrode and pixel electrode Here, the liquid crystal dielectric constant $\epsilon_{lc}$ has a temperature characteristic, so depending on the operating environment, Clc will fluctuate. Further, due to production variations, the cap $d_{pix}$ between the electrodes 4, 5 shown in FIG. 31 will not be a constant value for all panels, so also becomes a factor behind fluctuation of Clc. Further, Ccs is formed by the metal layer 1 and the metal layer 2 shown in FIG. 32 sandwiching in an interlayer film. This can be expressed by an equation as follows:

$$Ccs=\epsilon_{IL}*S_{cs}/d_{IL} \quad (18)$$

where, $\epsilon_{IL}$: dielectric constant of interlayer film, $S_{cs}$: Ccs area per pixel $d_{IL}$: thickness of interlayer film This interlayer film also fluctuates in film thickness $d_{IL}$ for each panel due to production variations. The Ccs also fluctuates like the Clc. Due to the above changes in the operating environment, production variations, etc., Clc/Ccs will not become a constant value. The applied voltage gain Avcs from the Cs line will vary greatly. If expressing this by the γ characteristic of the liquid crystal display device, as shown in FIG. 33A, it will be understood that there is a great effect due to this. With the general drive method, the operating environment and production variations have a great influence on the γ characteristic of the liquid crystals.

Figure 33B:
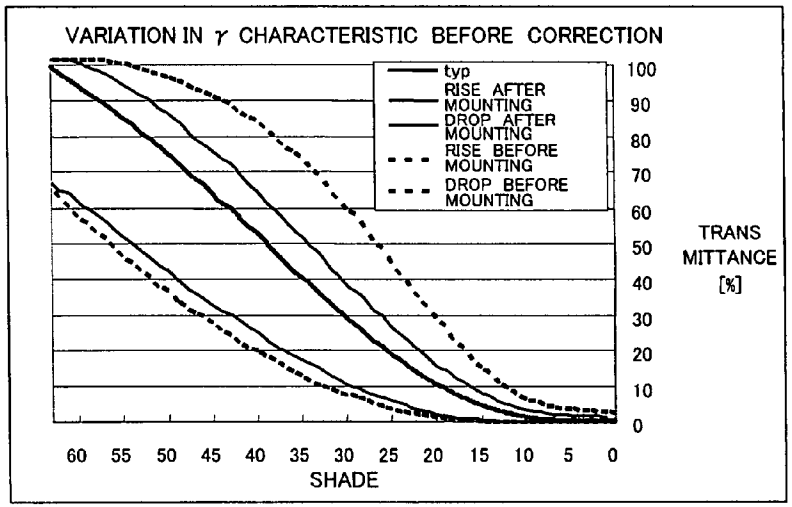

As opposed to this, the correction circuit unit of the present embodiment is characterized by suppression of this effect. The Vcs (=Vcsh−Vss) is dynamically corrected to suppress variations in voltage of the voltage gain Avcs applied from the Cs line. Further, part of the dummy pixels arranged around effective pixels are used to detect fluctuations in the operating environment and production variations. By mounting the correction circuit of the present embodiment, as shown in FIG. 33B, it will be understood that the final γ characteristic is improved by the correction circuit 302. That is, according to the present embodiment, the effects of the operating environment and production variations on the γ characteristic of a liquid crystal display device can be suppressed compared with the past.

Next, the operation by the above configuration will be explained.

A shift register of the vertical drive circuit 102 is supplied with a vertical start pulse VST instructing the start of the vertical scan and the vertical clocks VCK and VCKX with opposite phases serving as the criteria of the vertical scan generated by a not shown clock generator. The shift register performs a level shift operation on the vertical clocks and delays them by differing delay times. For example, in the shift register, the vertical start pulse VST is shifted synchronized with the vertical clock VCK and supplied to the corresponding gate buffer. Further, the vertical start pulse VST is propagated from the top or bottom of the effective pixel section 101 and is successively shifted to the shift registers. Therefore, basically, the gate lines 105-1 to **105-*m*** are driven in sequence through the gate buffers by the vertical clocks supplied by the shift register VSR.

In this way, the vertical drive circuit 102 drives the gate lines 105-1 to **105-*m* in sequence for example from the first row. Along with this, the storage lines 106-1 to 106-*m* are driven. At this time, one gate line is driven by the gate pulse, then the levels of the storage signals CS1 to CSm applied to the storage lines 106-1 to 106-*m* at the timing of the rising edge of the gate pulse of the next gate line are selected alternately and applied at the first level CSH and the second level CSL. For example, in the case where the first level CSH is selected and the storage signal CS1 is applied to the storage line 106-1 of the first row, the second level CSL is selected and the storage signal CS2 is applied to the storage line 106-2 of the second row, the first level CSH is selected and the storage signal CS3 is applied in the storage line 106-3 of the third row, and the second level CSL is selected and the storage signal CS4 is applied in the storage line 106-4 of the fourth row. In the same way below, the first level CSH and the second level CSL are alternately selected and the storage signals CS5 to CSm are applied to the storage lines 106-5 to 106-*m*. The storage signal is therefore corrected taking into account the optical characteristics so as to give the desired potential based on the potential of the dummy pixel section 108 detected by the detection circuit 109**.

Further, the alternate common voltage Vcom of the small amplitude ΔVcom is applied in common to the second pixel electrodes of the liquid crystal cells LC201 of all the pixel circuits PXLC of the effective pixel section 101.

Further, the horizontal drive circuit 103 receives a horizontal start pulse HST instructing the start of a horizontal scan and horizontal clocks HCK and HCKX with opposite phases serving as the reference for the horizontal scan generated by a not shown clock generator, generates a sampling pulse, successively samples the input video signal in response to the generated sample pulse, and supplies the results to the signal line 107-1 to **107-*n*** as data signals SDT to be written in the pixel circuits PXLC. For example, first, the R-use selector switch is controlled to the conductive state and the R data is output to the signal lines and written. When the write operation of the R data ends, only the G-use selector switch is controlled to the conductive state and the G data is output to the signal lines and written. When the write operation of the G data ends, only the B-use selector switch is controlled to the conductive state and the B data is output to the signal lines and written.

In the present embodiment, after the write operation from this signal line (after the trailing edge of the gate pulse GP), the pixel potential (the potential of the node ND201) is changed by coupling through the storage capacitor CS201 from the storage lines 106-1 to 106-*m*, and the voltage applied to the liquid crystal is modulated. At this time, the common voltage Vcom is supplied as an alternate signal by a small amplitude (10 mV to 1.0V) and not as a constant value. By this, not only the black luminance but also the white luminance is optimized.

As explained above, the present embodiment has a effective pixel section 101 comprised of a plurality of pixel circuits PXLC, each writing video pixel data through a TFT 201, arrayed in a matrix, gate lines 105-1 to 105-*m* positioned so as to correspond to the array of rows of the pixel circuits, a plurality of capacity lines 106-1 to 106-*m* positioned so as to correspond to the array of rows of the pixel circuits, signal lines 107-1 to 107-*m* positioned so as to correspond to the array of columns of the pixel circuit, a vertical drive circuit 102 selectively driving the gate lines and capacity lines, and a generation circuit 104 generating a common voltage signal of a small amplitude which switches in the level at a predetermined cycle, each pixel circuit containing a liquid crystal cell LC201 having a first pixel electrode and second pixel electrode and a storage capacitor CS201 having a first electrode and second electrode. The first pixel electrode of the liquid crystal cell, the first electrode of the storage capacitor, and one terminal of the TFT are connected. A second electrode of the storage capacitor is connected to the capacity line arrayed in the corresponding row. The common voltage signal is applied to the second pixel electrode of the liquid crystal cell. Therefore, both black luminance and white luminance can be optimized. As a result, there is the advantage of being able to optimize the contrast.

Further, in the present embodiment, fluctuations in the dielectric constant of the liquid crystal due to changes in the drive temperature, fluctuations in the thickness of the insulating film forming the storage capacitor CS201 due to variations at the time of mass production, and fluctuations in the liquid crystal cell cap cause the voltage applied to the liquid crystals. This fluctuation is electrically detected and fluctuations in the voltage applied to the liquid crystals are suppressed so as to suppress changes due to the temperature of the display and variations at the time of mass production.

Further, the CS driver in the vertical drive circuit 102 of the present embodiment determines the polarity of the CS signal without regard as to the stages before and after the driver of the polarity of the preceding frame, that is, by just the polarity (shown by POL) at the time of writing data in a pixel. That is, control becomes possible by just the signal of the stage in question without regard as to the signals of the stages before and after it in the present embodiment. Further, the CS block etc. of the vertical drive circuit of the present embodiment can be formed by small number of elements. This contributes to a reduction of the circuit size. For example 20 or less transistors may be used for their construction.

Note that in the above embodiment, the explanation was given of the case of application of the invention to a liquid crystal display device mounting an analog interface drive circuit receiving as input an analog video signal, latching this, then successively writing the analog video signal in the pixels in points, but the invention can be similarly applied to a liquid crystal display device mounting a drive circuit receiving as input a digital video signal and writing the video signal in the pixels in lines by the selector unit.

Further, in the above embodiment, the explanation was given of the case of application of the invention to an active matrix-type liquid crystal display device using liquid crystal cells as the display elements (electrooptic elements) of the pixels, but to invention is not limited to a liquid crystal display device. It may also be applied generally to active matrix type display devices such as active matrix type electroluminescence (EL) display devices using EL elements as the display element of the pixels. The display device according to the embodiment explained above can also be used for display panels of direct viewing type video display devices (liquid crystal monitors and liquid crystal viewfinders) and projection type liquid crystal display devices (liquid crystal projectors), that is, liquid crystal display (LCD) panels.

It should be understood by those skilled in the art that various modifications, combinations, sub-combinations, and alterations may occur depending on design requirements and other factors insofar as they are within the scope of the appended claims or the equivalents thereof.

What we claim is:

1. A display device comprising:

a pixel section having a plurality of pixel circuits, each writing video pixel data propagated through a switching element, arranged in a matrix, a plurality of scan lines arranged so as to correspond to an array of rows of the pixel circuits and control conduction of the switching elements, a plurality of capacity lines arranged so as to correspond to an array of rows of the pixel circuits, a plurality of signal lines arranged so as to correspond to an array of columns of the pixel circuits and carrying the pixel data, a drive circuit for selectively driving the plurality of scan lines and the plurality of capacity lines, and a generation circuit for generating a common voltage signal switched in level at a predetermined period, wherein each pixel circuit arrayed at the pixel section includes a display element having a first pixel electrode and second pixel electrode, and a storage capacitor having a first electrode and second electrode, a first pixel electrode of the display element, a first electrode of the storage capacitor, and one terminal of the switching element are connected, a second electrode of the storage capacitor is connected to the capacity line arrayed at a corresponding row, and a second pixel electrode of the display element is supplied with the common voltage signal, the drive circuit selectively applies a capacity line driving signal to an intended capacity line, the capacity line driving signal being selected from a first level or a second level, the second level being lower than the first level, (i) an amplitude of the common voltage signal and (ii) a difference between the first level and the second level of the capacity line driving signal are determined so that an effective pixel potential when the display element is a normally white mode liquid crystal cell is compensated for an optimal white display while the effective pixel potential for a black display is maintained as optimal;

wherein the effective pixel potential is obtained from a following approximate equation:

$$\Delta Vpix = Vsig + (Ccs/(Ccs + Clc))\Delta Vcs + (Clc/(Ccs + Clc))(\Delta Vcom/2) - Vcom$$

wherein ΔVpix is the effective pixel potential,

Vsig is a video signal voltage,

Ccs is a storage capacity,

Clc is a liquid crystal capacity,

ΔVcs is the difference between the first level and the second level of the capacity line driving signal, and Vcom is the amplitude of the common voltage signal.

2. A display device as set forth in claim 1, wherein the drive circuit drives the scan lines of the selected row, writes pixel data into the desired pixel circuits, then drives the capacity lines of the same row.

3. A display device as set forth in claim 1, wherein the amplitude of the common voltage signal and the difference between the first level and the second level of the capacity line driving signal are selected so that the effective pixel potential becomes a predetermined threshold value or less.

4. A display device as set forth in claim 3, wherein the pixel circuit has display elements including liquid crystal cells.

5. A display device as set forth in claim 1, wherein a voltage from a single dummy pixel element is used for adjusting the signal output from the generation circuit.

6. The display device according to claim 1, wherein the amplitude of the common voltage signal is 10 mV to 1.0 V with a polarity which inverts every horizontal scanning period.

7. A method of driving a display device comprising:

a pixel section having a plurality of pixel circuits, each writing video pixel data propagated through a switching element over a signal line, arranged in a matrix, a plurality of scan lines arranged so as to correspond to an array of rows of the pixel circuits and control conduction of the switching elements, and a plurality of capacity lines arranged so as to correspond to an array of rows of the pixel circuits, each pixel circuit arrayed at the pixel section includes a display element having a first pixel electrode and second pixel electrode, and a storage capacitor having a first electrode and second electrode, a first pixel electrode of the display element, a first electrode of the storage capacitor, and one terminal of the switching element are connected, and a second electrode of the storage capacitor is connected to the capacity line arrayed at a corresponding row, the method of the display device including the steps of:

driving the capacity lines individually, applying via a generation circuit a common voltage signal switched in level at a predetermined period to the second pixel electrode of the display element, and driving the scan lines of the selected row, writing pixel data into the desired pixel circuits, then driving the capacity lines of the same row, and further wherein the generation circuit selectively applies a capacity line driving signal to an intended capacity line, the capacity line driving signal being selected from a first level or a second level, the second level being lower than the first level, (i) an amplitude of the common voltage signal and (ii) a difference between the first level and the second level of the capacity line driving signal are determined so that an effective pixel potential when the display element is a normally white mode liquid crystal cell is compensated for an optimal white display while the effective pixel potential for a black display is maintained as optimal;

wherein the effective pixel potential is obtained from a following approximate equation:

$$\Delta Vpix = Vsig + (Ccs/(Ccs + Clc))\Delta Vcs + (Clc/(Ccs + Clc))(\Delta Vcom/2) - Vcom$$

wherein ΔVpix is the effective pixel potential,

Vsig is a video signal voltage,

Ccs is a storage capacity,

Clc is a liquid crystal capacity,

ΔVcs is the difference between the first level and the second level of the capacity line driving signal, and Vcom is the amplitude of the common voltage signal.

8. A display device comprising:

a pixel section having a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal, and a correction circuit unit for correcting the signals driving the capacity lines of the drive circuit, wherein each pixel circuit arrayed at the pixel section includes a display element having a first pixel electrode and second pixel electrode, and a storage capacitor having a first electrode and second electrode, a first pixel electrode of the display element pixel cell, a first electrode of the storage capacitor, and one terminal of the switching element are connected a second electrode of the storage capacitor is connected to the capacity line arrayed at a corresponding row, a second pixel electrode of the display element is supplied with the common voltage signal, and the correction circuit selectively applies a capacity line driving signal to an intended capacity line, the capacity line driving signal being selected from a first level or a second level, the second level being lower than the first level, (i) an amplitude of the common voltage signal and (ii) a difference between the first level and the second level of the capacity line driving signal are determined so that an effective pixel potential when the display element is a normally white mode liquid crystal cell is compensated for an optimal white display while the effective pixel potential for a black display is maintained as optimal;

wherein the effective pixel potential is obtained from a following approximate equation:

$$\Delta Vpix = Vsig + (Ccs/(Ccs + Clc))\Delta Vcs + (Clc/(Ccs + Clc))(\Delta Vcom/2) - Vcom$$

wherein ΔVpix is the effective pixel potential,

Vsig is a video signal voltage,

Ccs is a storage capacity,

Clc is a liquid crystal capacity,

ΔVcs is the difference between the first level and the second level of the capacity line driving signal, and Vcom is the amplitude of the common voltage signal.

9. A display device as set forth in claim 8, wherein the common voltage signal is a small amplitude signal switching in level at a predetermined cycle.

10. A display device as set forth in claim 9, wherein the correction circuit unit has a switch selectively outputting a monitor pixel potential of the monitor section to the correction circuit.

11. A display device as set forth in claim 9, wherein the monitor section and an input section of the correction circuit are arranged in close proximity.

12. A display device as set forth in claim 11, wherein the correction circuit unit has a switch selectively outputting a monitor pixel potential of the monitor section to the correction circuit.

13. A display device as set forth in claim 9, wherein the correction circuit unit includes a plurality of monitor pixels, first electrodes of the plurality of monitor pixels are connected in common, and a common connection line is connected to a connection line with the correction circuit.

14. A display device as set forth in claim 13, wherein the correction circuit unit has a switch selectively outputting a monitor pixel potential of the monitor section to the correction circuit.

15. A display device as set forth in claim 9, wherein the drive circuit drives the scan lines of the selected row, writes pixel data into the desired pixel circuits, then drives the capacity lines of the same row.

16. A display device as set forth in claim 9, wherein the pixel circuit has display elements having liquid crystal cells.

17. A display device as set forth in claim 8, wherein a voltage from a single dummy pixel element is used for adjusting the signal output from the generation circuit.

18. A display device comprising:

a pixel section having a plurality of pixel circuits, each writing video pixel data propagated through a switching element over a signal line, arranged in a matrix, a plurality of scan lines arranged so as to correspond to an array of rows of the pixel circuits and control conduction of the switching elements, a plurality of capacity lines arranged so as to correspond to an array of rows of the pixel circuits, a drive circuit for selectively driving the plurality of scan lines and the plurality of capacity lines, a generation circuit for generating a common voltage signal, and a reference driver for generating video pixel data to be propagated over a signal line, wherein each pixel circuit arrayed at the pixel section includes a display element having a first pixel electrode and second pixel electrode, and a storage capacitor having a first electrode and second electrode, a first pixel electrode of the display element pixel cell, a first electrode of the storage capacitor, and one terminal of the switching element are connected, a second electrode of the storage capacitor is connected to the capacity line arrayed at a corresponding row, a second pixel electrode of the display element is supplied with the common voltage signal, and the reference driver has a monitor section monitoring a pixel potential of the pixel section and a correction circuit correcting the signal voltage in the reference driver based on results of monitoring of the monitor circuit, the correction circuit selectively applies a capacity line driving signal to an intended capacity line, the capacity line driving signal being selected from a first level or a second level, the second level being lower than the first level, (i) an amplitude of the common voltage signal and (ii) a difference between the first level and the second level of the capacity line driving signal are determined so that an effective pixel potential when the display element is a normally white mode liquid crystal cell is compensated for an optimal white display while the effective pixel potential for a black display is maintained as optimal;

wherein the effective pixel potential is obtained from a following approximate equation:

$$\Delta Vpix = Vsig + (Ccs/(Ccs + Clc))\Delta Vcs + (Clc/(Ccs + Clc))(\Delta Vcom/2) - Vcom$$

wherein ΔVpix is the effective pixel potential,

Vsig is a video signal voltage,

Ccs is a storage capacity,

Clc is a liquid crystal capacity,

ΔVcs is the difference between the first level and the second level of the capacity line driving signal, and Vcom is the amplitude of the common voltage signal.

* * * * *